US009261320B2

(12) United States Patent
Campbell et al.

(10) Patent No.: US 9,261,320 B2
(45) Date of Patent: Feb. 16, 2016

(54) MAGAZINE BLOCK FOR DRY FIRE PRACTICE

(71) Applicants: David L. Campbell, Dalton, GA (US); William H. Rogers, St. Augustine, FL (US); Matthew E. McKendrick, Jacksonville, FL (US)

(72) Inventors: David L. Campbell, Dalton, GA (US); William H. Rogers, St. Augustine, FL (US); Matthew E. McKendrick, Jacksonville, FL (US)

(73) Assignee: Rogers Holster Co., LLC, Jacksonville, FL (US)

( * ) Notice: Subject to any disclaimer, the term of this patent is extended or adjusted under 35 U.S.C. 154(b) by 0 days.

(21) Appl. No.: 14/335,158

(22) Filed: Jul. 18, 2014

(65) Prior Publication Data

US 2015/0198404 A1 Jul. 16, 2015

Related U.S. Application Data

(63) Continuation of application No. 29/479,014, filed on Jan. 10, 2014.

(51) Int. Cl.

| | |
|---|---|
| ***F41A 17/44*** | (2006.01) |
| ***F41A 35/00*** | (2006.01) |
| ***F41A 9/65*** | (2006.01) |
| ***F41A 17/34*** | (2006.01) |
| ***F41A 33/00*** | (2006.01) |

(52) U.S. Cl.

CPC . *F41A 35/00* (2013.01); *F41A 9/65* (2013.01); *F41A 17/34* (2013.01); *F41A 33/00* (2013.01)

(58) Field of Classification Search

CPC ..... F41A 17/44; F41A 33/02; F41A 35/00; F41A 9/65; F42B 8/02; F42B 8/08

USPC ..... 42/70.01, 70.11, 70.08, 96, 106, 70.02; 102/444

See application file for complete search history.

(56) References Cited

U.S. PATENT DOCUMENTS

| | | | | |
|---|---|---|---|---|
| 119,357 | A | 9/1871 | Hobbs | |
| 3,750,531 | A | 8/1973 | Angell et al. | |
| 3,848,350 | A | 11/1974 | Seminiano | |
| 5,435,090 | A | 7/1995 | Darrow | |
| 6,141,895 | A * | 11/2000 | Rost | F41A 35/06 42/6 |
| 6,223,657 | B1 | 5/2001 | Proffitt | |
| 6,443,069 | B2 | 9/2002 | Proffitt | |
| 6,470,615 | B1 | 10/2002 | Peterken | |

(Continued)

FOREIGN PATENT DOCUMENTS

| | | |
|---|---|---|
| EP | WO9628704 | 9/1996 |
| EP | WO9923439 | 5/1999 |
| EP | WO0171269 | 9/2001 |

*Primary Examiner* — Michael David

(74) *Attorney, Agent, or Firm* — Arthur G. Yeager

(57) ABSTRACT

Magazine block device for firearm dry fire practice which allows a user to practice proper firearm handling skills without expending ammunition, including recocking and actuating the firearm slide without pressing the slide lock release. In an aspect, a magazine block device is provided having a bullet-shaped body, two upper ridges forming a longitudinal channel through which the firearm breach face loading tab may pass without dislodging the magazine block device, and an offset lower ridge. The lower ridge is configured to evenly force a magazine follower down a sufficient distance to prevent actuation of the firearm slide lock. This allows dry fire practice of pulling the slide. Several other features include ridges to assist a user to remove and load the block device in and out of a magazine, as well as a pocket to mechanically remove same.

20 Claims, 23 Drawing Sheets

(56) References Cited

U.S. PATENT DOCUMENTS

| | | | | |
|---|---|---|---|---|
| 6,543,171 | B2 | 4/2003 | Kellerman | |
| 6,572,375 | B2 | 6/2003 | Shechter et al. | |
| 6,755,054 | B2 * | 6/2004 | Burmesch | E05B 67/36 42/70.11 |
| 6,871,438 | B2 | 3/2005 | Lawless | |
| 6,895,707 | B2 * | 5/2005 | Young | F41A 17/44 42/70.11 |
| 7,240,449 | B2 | 7/2007 | Clifton, Jr. | |
| 7,661,219 | B1 * | 2/2010 | Knight, Jr. | F41A 3/42 42/17 |
| 8,191,298 | B2 * | 6/2012 | Cash | F41A 9/65 42/49.02 |
| 8,572,878 | B2 | 11/2013 | Gentilini et al. | |
| 2013/0019510 | A1 * | 1/2013 | Kemmerer | F41A 17/20 42/1.01 |
| 2013/0019512 | A1 * | 1/2013 | Kemmerer | F41A 17/066 42/70.05 |
| 2013/0125441 | A1 * | 5/2013 | Westwood | F41A 17/02 42/70.05 |
| 2013/0295527 | A1 | 11/2013 | Uhr | |

* cited by examiner 501
406a
312
402
404
308
300
302
306

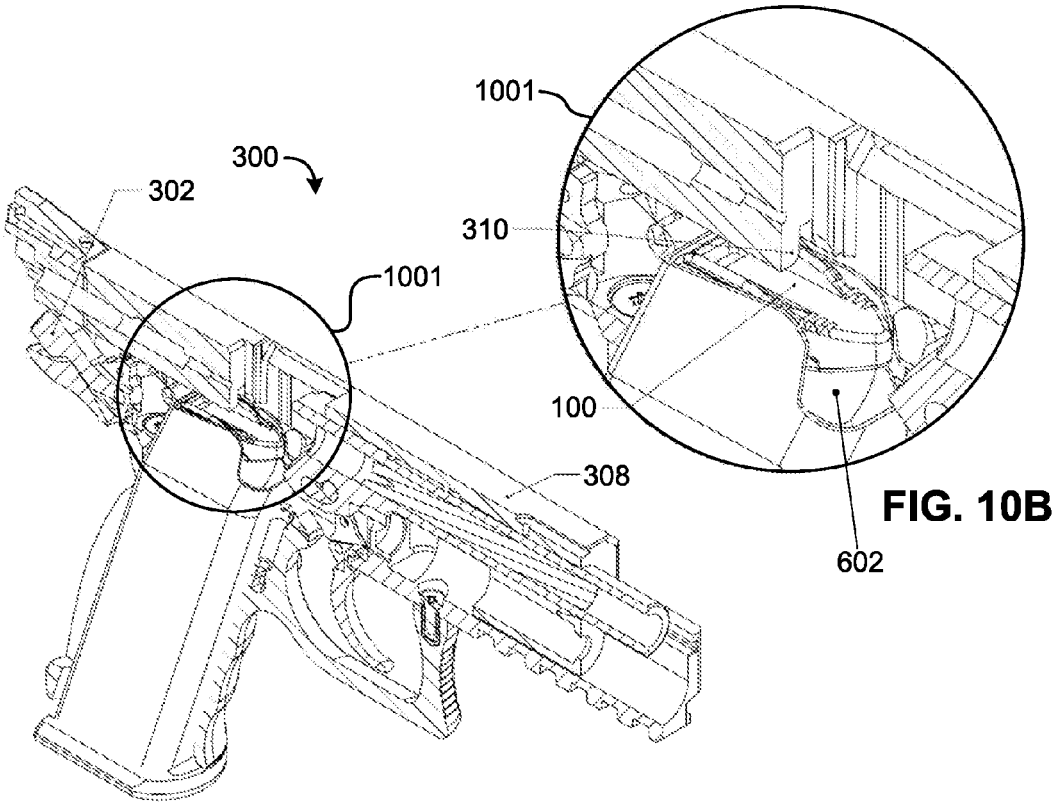
FIG. 10B
FIG. 10A
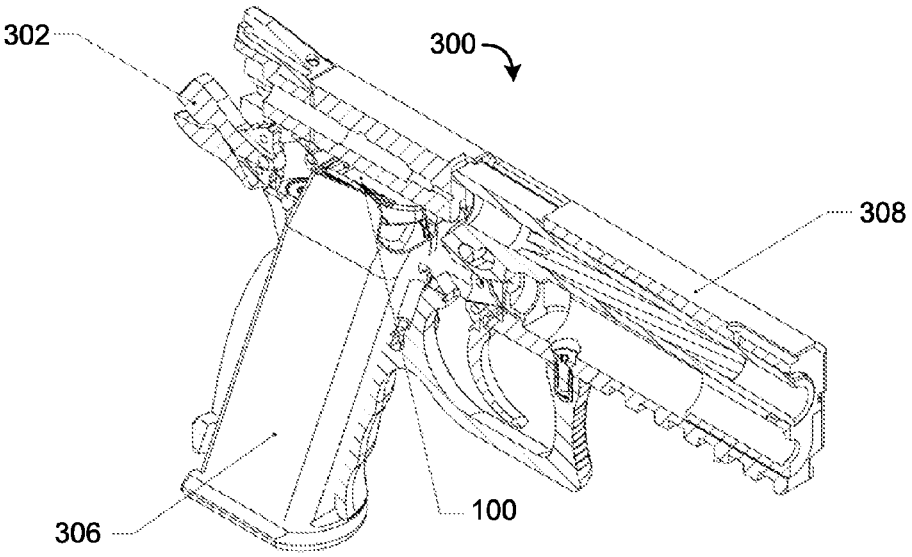
FIG. 11

MAGAZINE BLOCK FOR DRY FIRE PRACTICE

CROSS-REFERENCE TO RELATED APPLICATION

This application claims the benefit of U.S. Design patent application Ser. No. 29/479,014, filed Jan. 10, 2014, and entitled "Dry Fire Practice Magazine Block," the entire contents of which are incorporated herein by reference.

FIELD OF THE DISCLOSURE

The present disclosure relates to firearms, and more particularly to dry-fire practice equipment.

BACKGROUND

Dry fire practice involves manipulating and using the weapon without loading it. The technique is often used to simulate actual firing of the firearm when there is not a suitable place to practice with live ammunition. The user may handle, aim, pull the trigger, pull the slide and/or cock the firearm during such practice. Dry fire exercises are a versatile and safe way to practice with firearms and improve one's shooting skills. Historically safety or "dummy" rounds have been used to simulate proper loading, reloading, and quick trigger engagement after reloading. However it is laborious and time consuming to load the practice magazine and then have to retrieve the ejected safety rounds from the ground. Most pistols use magazines featuring a spring loaded follower. When the magazine is emptied, the follower engages a slide lock which prevents travel of the slide until a new, loaded magazine is inserted. While this functionality is useful for quickly reloading the firearm during live firing, it hampers practicing with the firearm because the operator must disengage the slide lock after insertion of a fresh magazine. If that magazine is empty the spring loaded follower prevents the disengagement of the slide stop. As mentioned above the historic use of safety rounds is problematic.

Some pistols, such as the Smith & Wesson M&P9c pistol (available from Smith & Wesson Corp. of Springfield, Mass.), contain a magazine safety. Such pistols cannot function without a magazine, preventing the most basic practice of cycling the slide to cock the firearm and then pulling the trigger. Using an empty magazine automatically locks the slide back with each cycle, which hinders the drill. Thus use of safety rounds is very inefficient.

Devices are known which facilitate using a firearm to practice.

U.S. Pat. No. 119,357, issued to A. C. Hobbs on Sep. 26, 1871, discloses a black cartridge containing no gun powered. The cartridge includes a rubber disk positioned at the rear of the cartridge casing. During dry fire practice, the Hobbs blank is chambered and the disk absorbs blows from the firing pin, allowing the user to simulate some firing actions.

Improvements on the Hobbs blank are known, such as the firearm snap cap disclosed in U.S. Pat. No. 5,435,090 issued to J. E. Darrow on Jul. 25, 1995. The snap cap is also designed to be chambered and consists of a bore cleaning brush attached to a unit body having a diameter equal to the diameter of ammunition used with the firearm.

While the Hobbs blank, the Darrow snap cap, and other types of chamber-able simulated ammunition may be used during dry fire practice, such practice ammunition may be expelled prematurely if the firearm's round ejection mechanisms are simulated (e.g., pulling a pistol slide back when a practice round is in the chamber). Thus, practicing actuating the firearm slide, reloading the firearm magazine, and other techniques may be difficult and/or require multiple rounds of practice ammunition.

Other safety devices are known, such as the magazine block device disclosed in U.S. Pat. No. 7,240,449 issued to N. E. Clifton on Jul. 10, 2007. The Clifton magazine block is designed to be inserted into a magazine and, when the magazine is loaded into a rifle, the magazine block occupies the loading chamber, thereby preventing live rounds of ammunition from being loaded while still allowing the user to practice with the rifle. Some designs of the Clifton magazine block impede full motion of the firearm slide and/or charging handle.

Given the foregoing, what are needed are devices which allow a user to conduct dry fire practice drills with a firearm, including magazine removal are reload exercises.

BRIEF SUMMARY OF THE INVENTION

This summary is provided to introduce a selection of concepts in a simplified form that are further described below in the Detailed Description. It is not intended to identify key features or essential features of the subject matter to be claimed, nor is it intended to be used to limit the scope of the subject matter to be claimed.

The present disclosure is directed to magazine block devices. Magazine block devices in accordance with the present disclosure may be used with pistols, rifles, and other firearms during dry fire practice, enabling a user to learn and maintain proper firearm handling skills without expending ammunition, thus reducing costs and increasing safety during such exercises, In an aspect, a magazine block device is provided having a bullet-shaped body. The magazine block device is designed to be inserted into a magazine having an offset, spring-loaded follower. The magazine block device body includes two upper ridges positioned along to outer edge of the body. The upper ridges form a longitudinal channel through which the firearm breath face loading tab may pass without dislodging the magazine block device. The upper ridges contact the feed lips of the magazine, keeping the magazine block device in position.

Magazine followers are often angled, therefore the bottom portion of the magazine block device may comprise an offset lower ridge. The lower ridge is configured to evenly force the follower down a sufficient distance to prevent actuating the firearm slide lock. This allows dry fire practice of pulling the slide, The magazine block device may also comprise one or more cutouts, protrusions, or other portions designed to help a user insert or remove the magazine block device from the magazine. In some aspects, the magazine block device may be inserted and removed from a magazine by hand, enabling the user to quickly prepare a firearm for dry fire practice and return the firearm to live, operational status by simply inserting a magazine containing live ammunition or removing the magazine block device from a magazine, reloading that magazine with ammunition, and loading the magazine into the firearm.

In an aspect, the magazine block device allows the user to dry fire practice with a semi-automatic pistol without having the slide lock engage. Because dry fire practice necessitates having the pistol or other firearm free of ammunition in the magazine as well as the chamber, the built in slide lock will always lock the slide in the rear, or open, position when the pistol is cycled, or re-cocked, to reset the trigger into the "fire"

position. This requires the user to disengage the slide lock after every cocking cycle which is disruptive to dry fire practice techniques. Among other things, having to constantly disengage the slide lock after every trigger pull and recock cycle disrupts the hand position, target focus and mental concentration.

The slide lock is a feature in all semi-automatic pistols to alert the user when the magazine is empty or all rounds have been expended. After the last round in the magazine is chambered, the magazine follower rises to the top of the magazine, by spring pressure, until it engages the feed lips of the magazine body. When in this upper-most position, the magazine follower pushes up on the slide-lock of the pistol so that after the next shot and recocking cycle, the slide of the pistol engages this slide lock and holds the slide in its most rearward, or open, position.

In an aspect, a magazine block device prevents the slide lock from engaging by simulating a round in the feed position in the magazine. This pushes the magazine follower down low enough as to prevent engagement of the slide lock, allowing the slide to return to the closed, or locked, position. The user only need manually cycle the slide of the pistol after each "dry fire" trigger pull with the magazine block device installed, avoiding the extra, disruptive step of disengaging the slide lock.

Further features and advantages of the devices and systems disclosed herein, as well as the structure and operation of various aspects of the present disclosure, are described in detail below with reference to the accompanying figures.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

FIGS. 10A & B are cutaway views of a firearm wherein the firearm magazine houses a magazine block device preventing the slide lock from engaging, thereby allowing the slide to return after being pulled back.

FIG. 11 is a cutaway view of a firearm wherein the firearm magazine houses a magazine block device.

DETAILED DESCRIPTION OF THE INVENTION

The present disclosure is directed to magazine block devices for dry fire practice. Devices in accordance with the present disclosure allow users of pistols, rifles and other firearms to conduct dry fire practice while having the firearm free of any ammunition in the magazine, as well as the chamber. Magazine block devices in accordance with the present disclosure prevent the firearm slide lock from engaging after every cocking cycle. Such devices also remain engaged within the device after each cocking cycle, even where such cycles are designed to expel chambered ammunition casings and/or dummy rounds.

Figure 1:
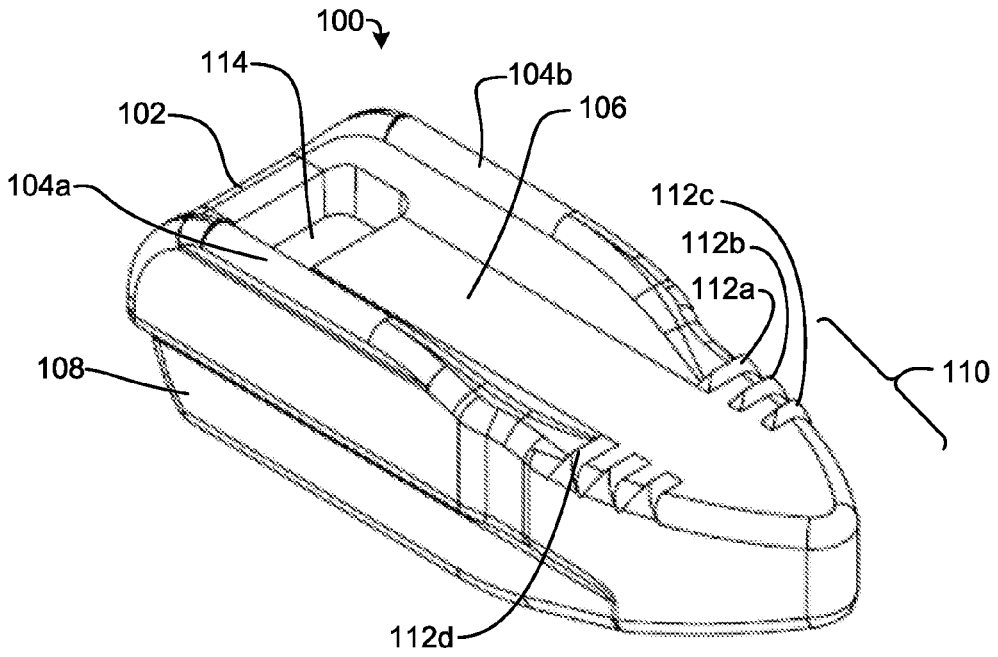
FIG. 1 is a top perspective view of a dry fire practice magazine block device, in accordance with the present disclosure.
Figure 2:
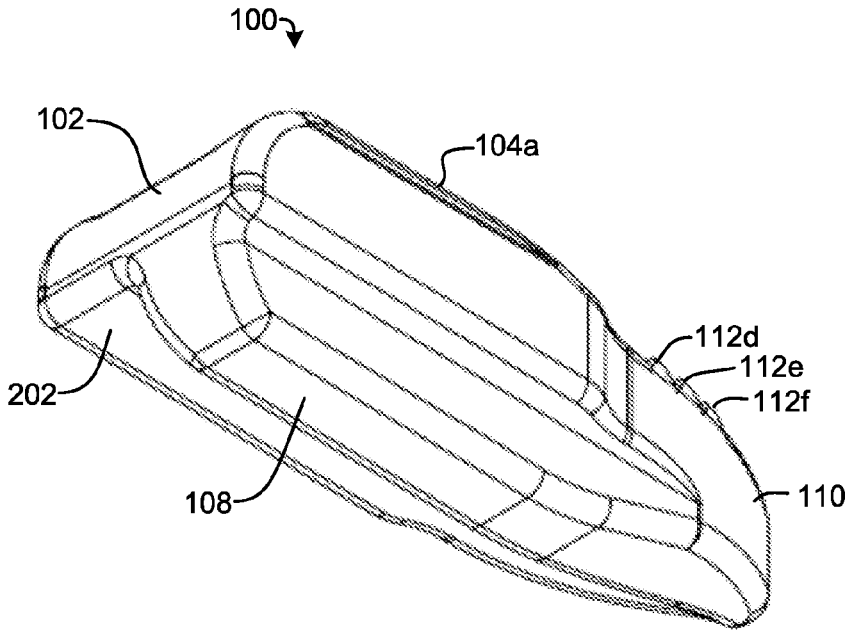
FIG. 2 is a bottom perspective view of the magazine block device of FIG. 1.

Referring now to FIG. 1-2, a top and a bottom perspective view of a dry fire practice magazine block device 100 are shown and described in accordance with various aspects of the present disclosure.

Magazine block device 100 may be constructed out of any appropriate material including, but not limited to, a polymer, metal, wood, rubber, and/or combinations thereof. Magazine block device 100 comprises a body 102 and may be bullet-shaped, resembling the profile of the ammunition magazine block device 100 that replaces an ammunition round during dry fire practice. The cross section of body 102 is substantially similar to the cross section of such ammunition. Body 102 may include a curved front portion 110. Curved front portion 100 ensures that device 100 fits into magazines designed for bullets having similar profiles.

Two upper ridges 104 are positioned along the outer edge of body 102. Upper ridges 104 extend vertically from body 102. In some aspects, upper ridge 104 extends approximately two millimeters from the top surface of body 102. As shown in greater detail in FIGS. 6-11, upper ridges 104 are designed to simulate the side of a bullet casing and position device 100 properly within a magazine by contacting the feed lips of the magazine. Upper ridge 104 has a flat outer surface, a curved inner surface, and extends most of the length of device 100. In some aspects, the front of upper ridge slopes downward, forming a smooth interface with other portions of body 102.

Two ridges 104 form a longitudinal channel 106 along the top surface of device 100. Channel 106 allows firearm loading mechanisms, such as a breach face loading tab of a pistol (see FIGS. 3-5 and FIG. 18) to freely move without chambering device 100, a round, or any other item. This allows the user to perform dry fire exercises such as cocking the firearm without expelling device 100.

Device 100 may be configured for use with spring loaded magazines having angled followers. Device 100 may further include a lower ridge 108 extending down from body 102 in order to contact the follower and maintain the follower in a position that will not actuate the firearm slide lock or other magazine reloading mechanism. In an aspect, lower ridge 108 extends approximately four millimeters downward and is offset relative to the longitudinal axis of device 100. This configuration, shown in FIG. 1, is configured to evenly force the follower down a sufficient distance to prevent actuating the firearm slide lock. This allows dry fire practice of pulling the slide freely and performing other recocking actions without actuating the slide release mechanism. Lower ridge 108 extends in a direction parallel to the longitudinal axis of device 100. At a front portion, lower ridge 108 slopes upward, connecting with other portions of device 100. The outer side of lower ridge 108 is substantially vertical. The inner side of lower ridge 108 may be curved in order to interface with the surface of the magazine follower.

Front portion 110 may include one or more flanges 112 extending inwardly toward the longitudinal axis of device 100. Each flange 112 is raised slightly with respect to the surface of body 102 such that a user may push or pull against flange 112 in order to install or remove device 100 from a magazine. Flanges 112 may be positioned along other portions of device 100, such as upper ridges 104, body sides, and the like.

Device 100 may also comprise one or more cutouts, protrusions, or other portions designed to help a user insert or remove the magazine block device 100 from the magazine. In some aspects, the magazine block device 100 may be inserted and removed from a magazine by hand, enabling the user to quickly prepare a firearm for dry fire practice and return the firearm to live, operational status by simply inserting a magazine containing live ammunition or removing magazine block device 100 from a magazine, reloading that magazine with ammunition, and loading the magazine into the firearm.

In an aspect, body 102 may comprise pocket 114. A tool or other rigid member may be inserted into pocket 114 in order to aid in the removal of device 100 from a magazine, As will be apparent to those skilled in the relevant art(s) after reading the description herein, device 100 may be configured to function with firearms using various types of ammunition (e.g., 9 mm, .308, .45ACP, 12ga., .22LR, 5.56x45 mm, 7.62×51 mm, .357 Magnum), having varying magazine designs (e.g., single column, staggered, internal box, detachable box, STANAG magazine) and the like. Device 100 may be configured to inhibit round loading mechanisms and/or casing ejection mechanisms apart from those shown and described herein.

Figure 3:
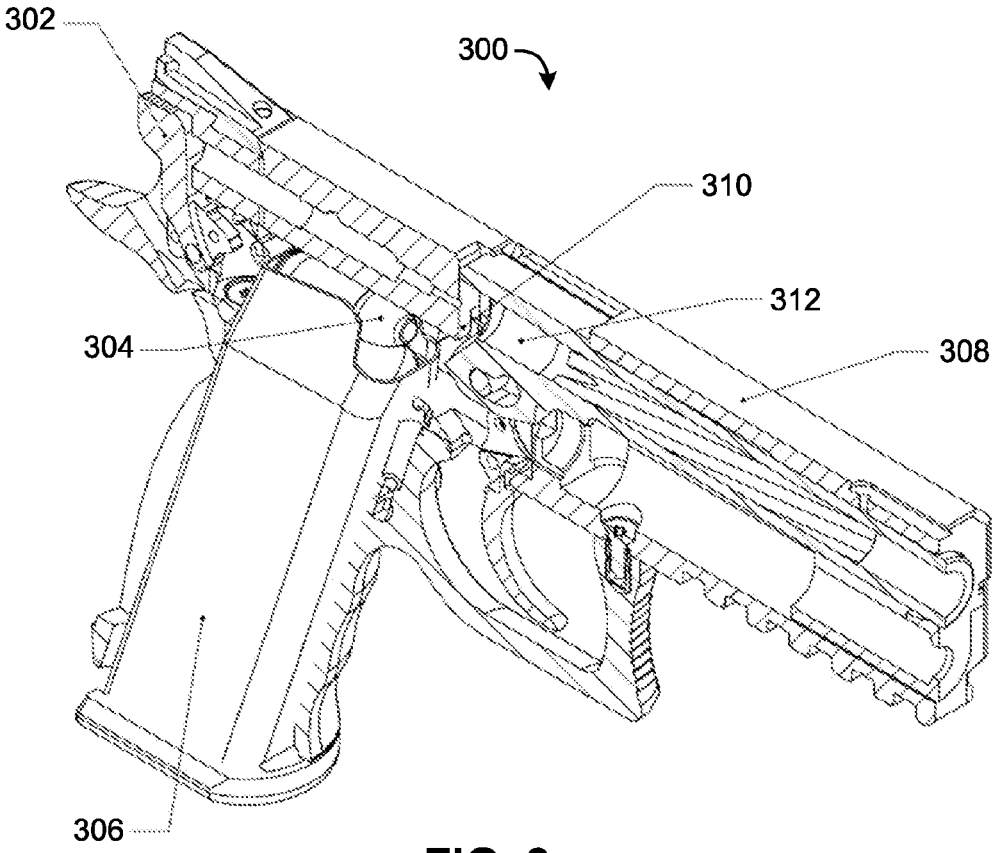
FIG. 3 is a perspective cutaway view of a firearm detailing the firearm internal components, having a round loaded in the magazine but not chambered.
Figures 4A, 4B:
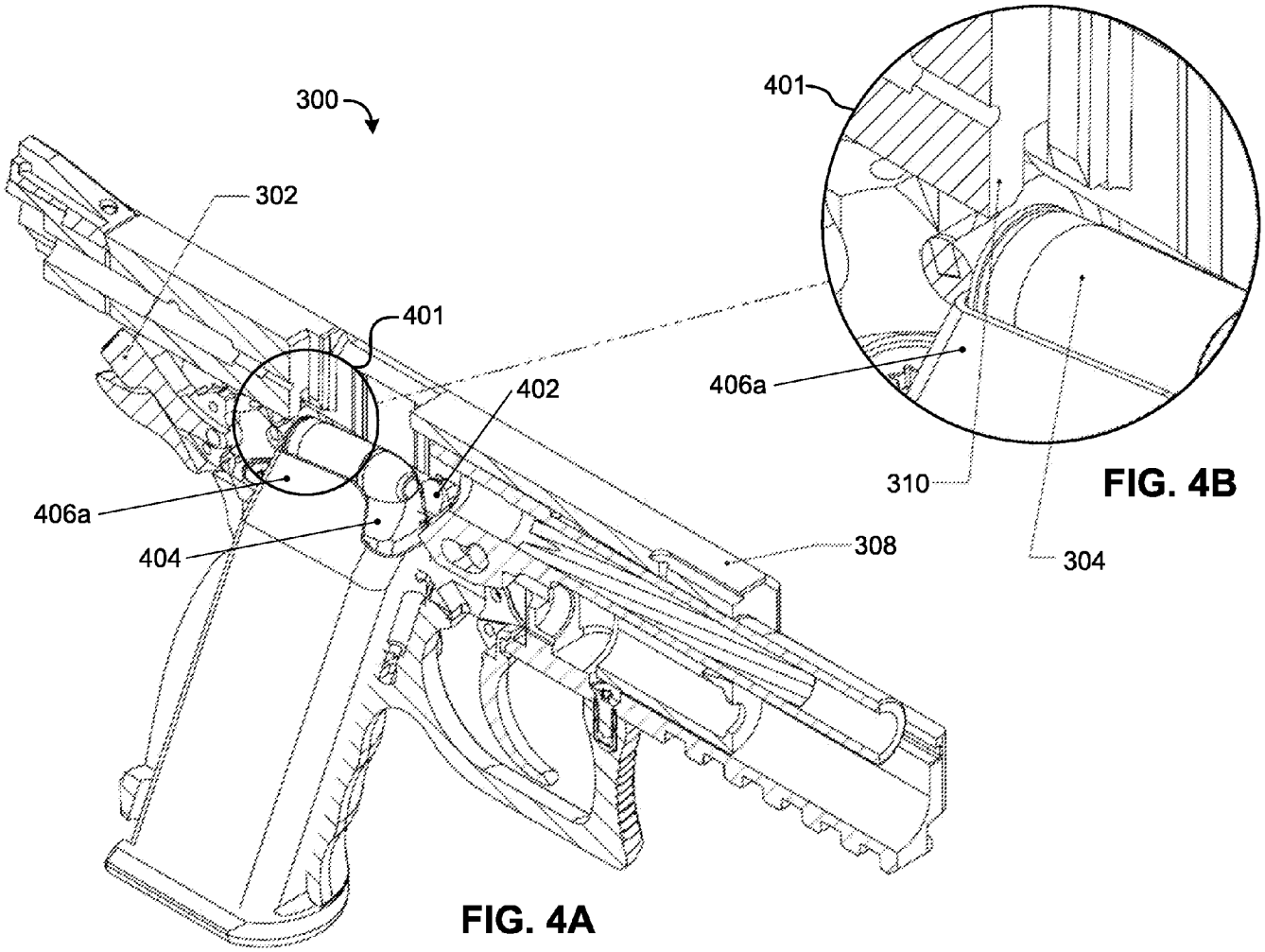
FIGS. 4A & B are cutaway views of the firearm of FIG. 3, wherein the slide has been pulled back in order to chamber the round and the slide lock being disengaged.
Figures 5A, 5B:
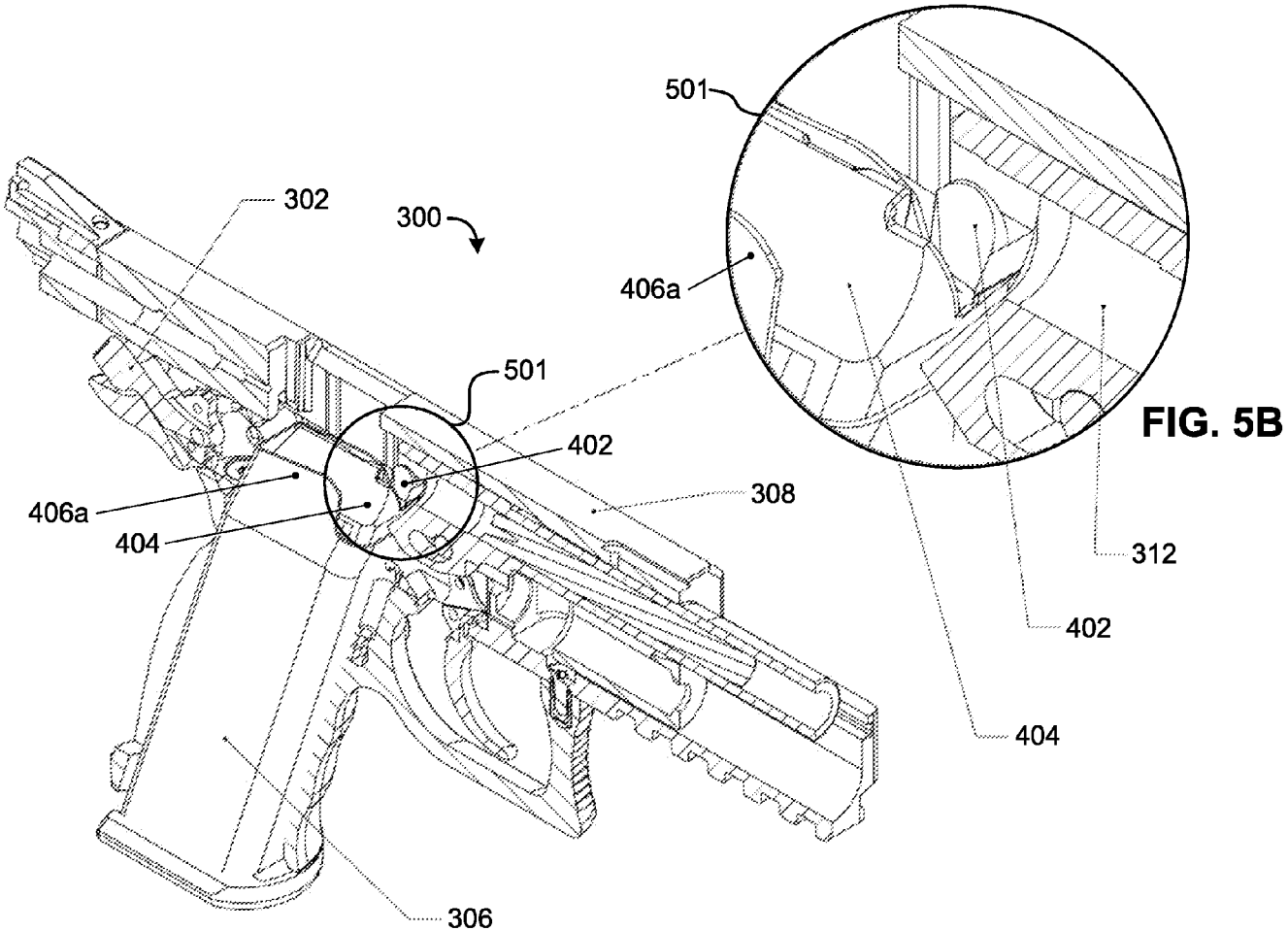
FIGS. 5A & B are cutaway views of a firearm detailing the firearm internal components wherein no round is present and the slide lock is engaged.

Referring now to FIGS. 3-5, cutaway views of a firearm 300 are shown, depicting operations of portions of firearm 300.

Pistol 300 includes a hammer 302. Hammer 302 may be manually cocked or may be cocked by movement of a slide 308. Slide 308 has a breach face loading tab 310 configured to push a round 304 into a firing chamber 312 from a magazine 306. Before round 304 is loaded into chamber 312, round 304 is held in place within magazine 306 by a pair of feed lips 406 and a follower 404. Feed lips 406 constrain the motion of round 304 because follower 404 is spring loaded and forces round against feed lips 406. Slide 308 can freely move unless a slide lock 402 is engaged. Slide lock 402 is engaged when no rounds 304 or other objects remain in magazine 306, thereby allowing follower 404 to press against slide lock 402. Engaging slide lock 402 locks slide 308 into an open position. In order to move slide 308 from the locked position a slide lock release must be pressed by the user. Pressing the slide lock release is not part of a normal firing sequence; therefore avoiding such an action during dry fire practice is desired. Device 100 may be utilized in order to avoid such an action because device 100 prevents upward movement of follower 404, preventing follower 404 from engaging slide lock 402.

Detail view 401 shows tab 310 positioned near the rear of round 304. As tab 310 moves forward, it pushes round 304 out of magazine 306 and into chamber 312.

Detail view 501 shows follower 404 engaging slide lock 402 when follower 404 is not vertically constrained by round 304, device 100, or another object.

Figure 6C:
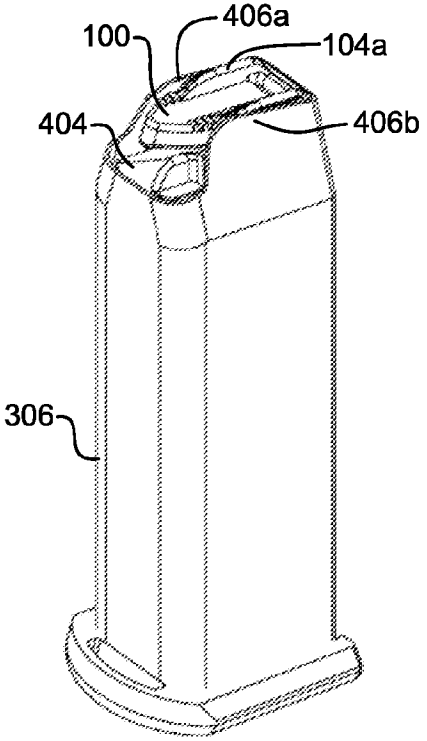
FIGS. 6A-C are perspective views of a magazine and a magazine block device being inserted into the magazine, in accordance with an aspect the present disclosure.
Figure 6B:
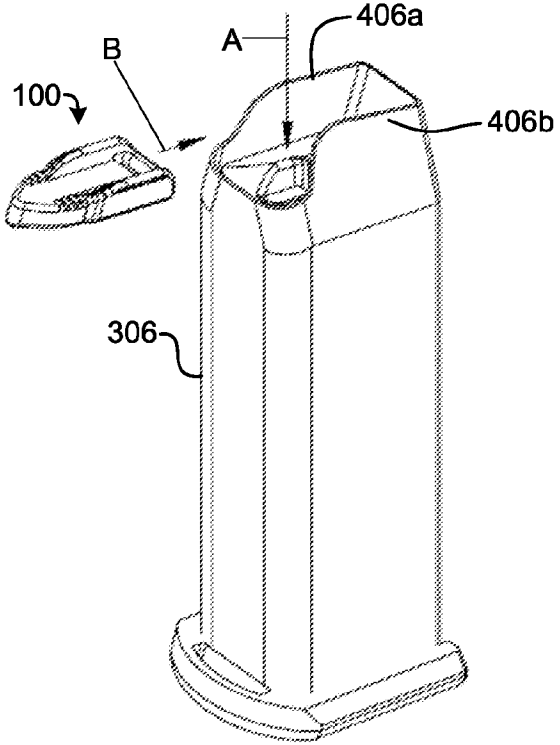
Figure 6A:
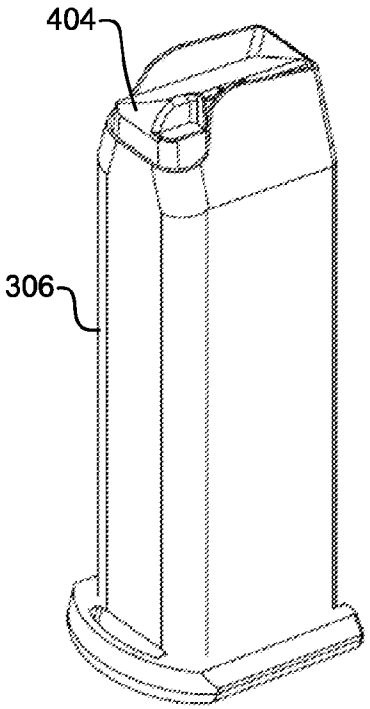

Referring now to FIGS. 6A-C, perspective views of magazine 306 and device 100 are shown. In particular, FIGS. 6A-C shown how device 100 is inserted into empty magazine 306 in order to prepare magazine 306 for use in dry fire practice.

When follower 404 is in the position shown in FIG. 6A, slide lock 402 is activated. In order to avoid activating slide lock 402 during dry fire practice, vertical movement of follower 404 must be limited using device 100.

As shown in FIG. 6B, follower 404 is first pushed down in direction A. Magazine block device 100 is then inserted above follower 404 in direction B. The edges of device 100 may be curved in order to push follower 404 down via insertion of device 404 as shown in FIG. 6B.

As shown in FIG. GC, upper ridges 104 each contact a feed lip 406, maintaining the position of device 100. Lower ridge 108 pushes follower 404 downward, ensuring that it cannot engage slide lock 402 when the magazine shown in FIG. 6C is in use.

Figure 7B:
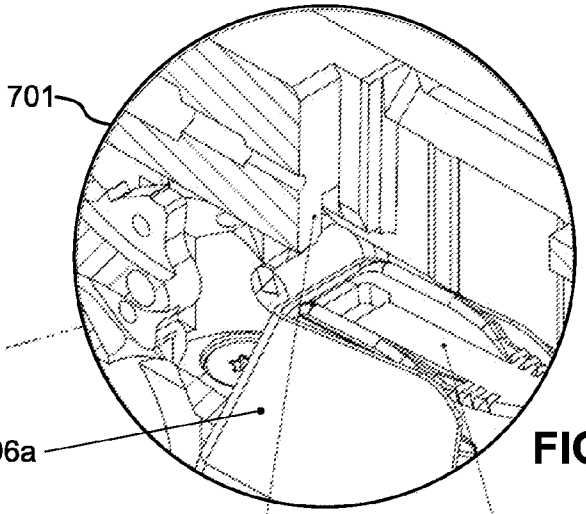
FIGS. 7A & B are cutaway views of a firearm wherein the firearm magazine houses a magazine block device preventing the slide lock from engaging.
Figure 7A:
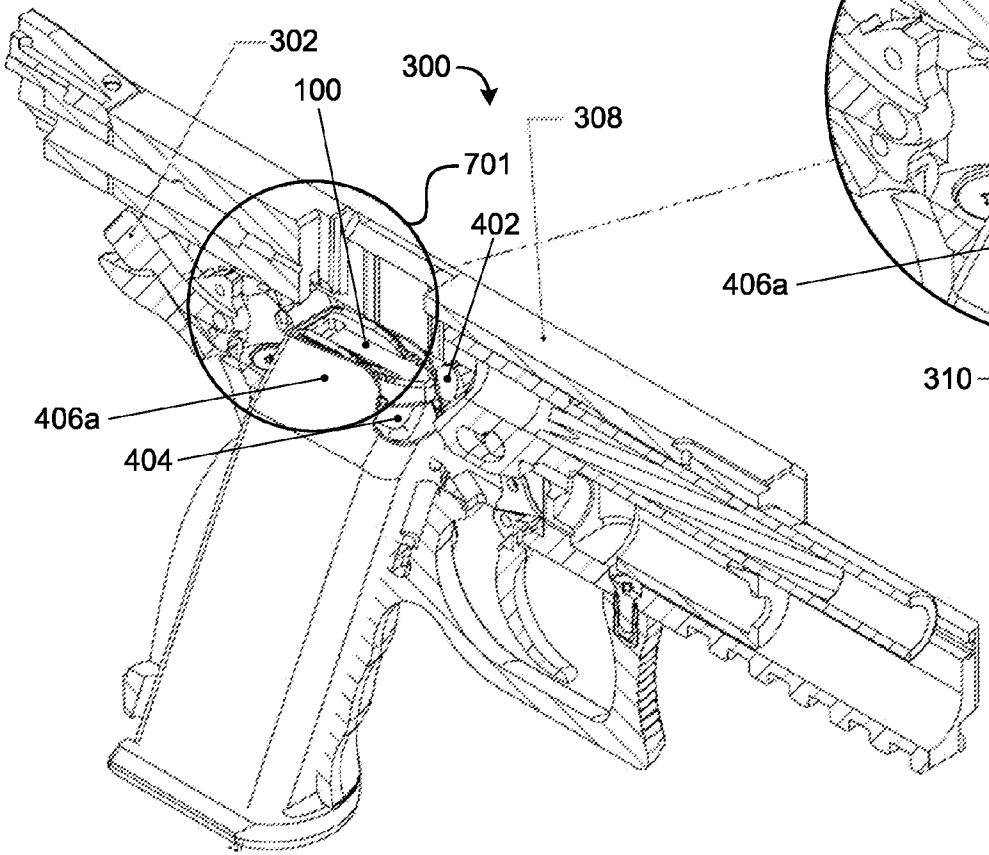

Referring now to FIGS. 7A-8B, cutaway views of firearm 300, wherein magazine 306 houses device 100, are shown. Device 100 is inserted into magazine 306 as shown in FIGS. 6A-C. As shown in FIGS. 7A & B, magazine 306 is then inserted into firearm 300 as normal.

FIG. 7B is a detail view of area 701. As show in FIG. 7B, when magazine 306 is equipped with device 100, tab 310 moves freely through channel 106. Tab 310 does not contact device 100, therefore no object is loaded into chamber 312 and firearm 300 may be cycled may times during practice.

Figures 8A, 8B:
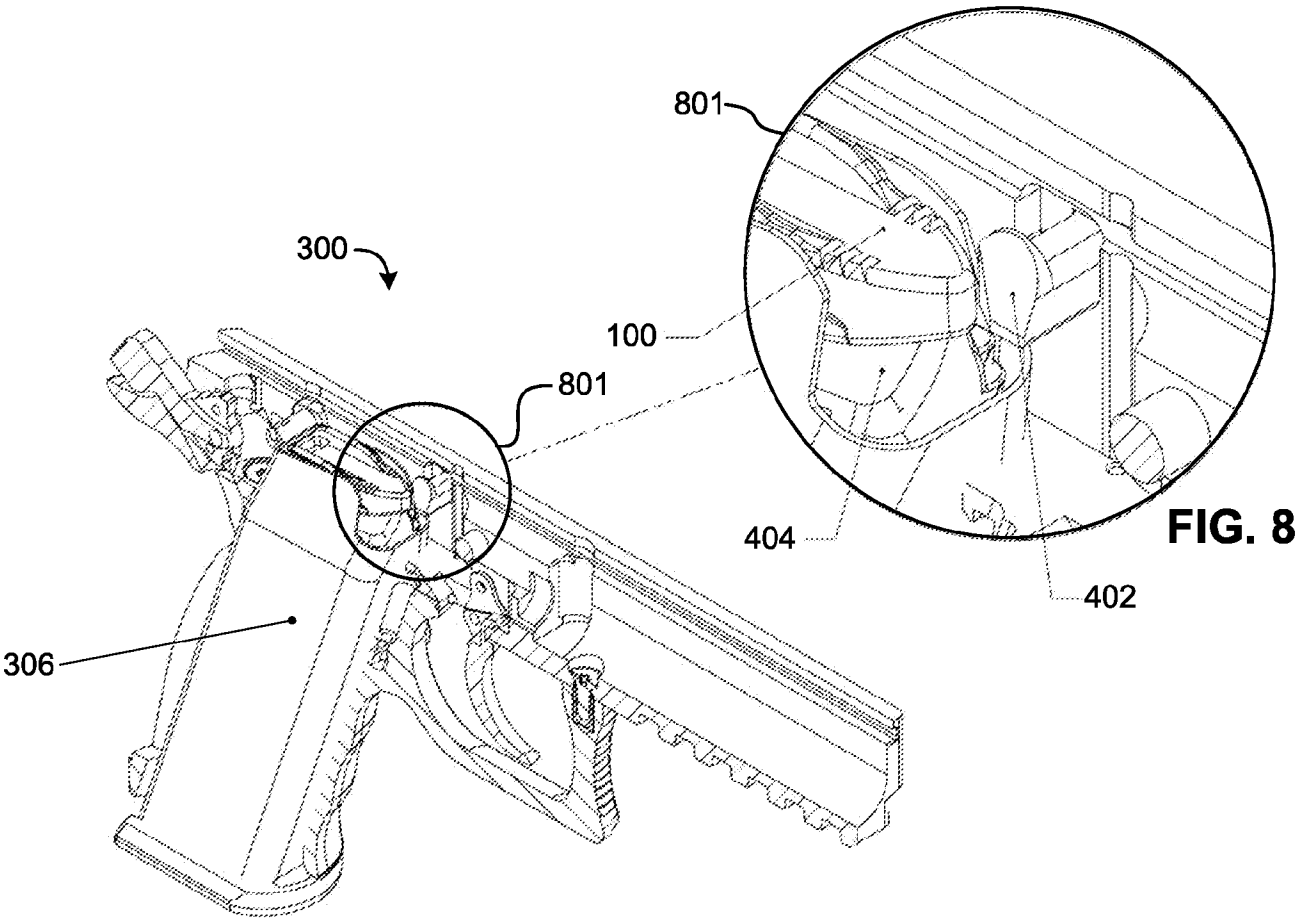
FIGS. 8A & B are cutaway views of a firearm wherein the firearm magazine houses a magazine block device preventing the slide lock from engaging and the slide and barrel being removed.

FIG. 88 is a detail view of area 801 of FIG. 8A. As shown in FIG. 8B, when magazine 306 is equipped with device 100, follower 404 does not engage slide lock 402.

Figure 9:
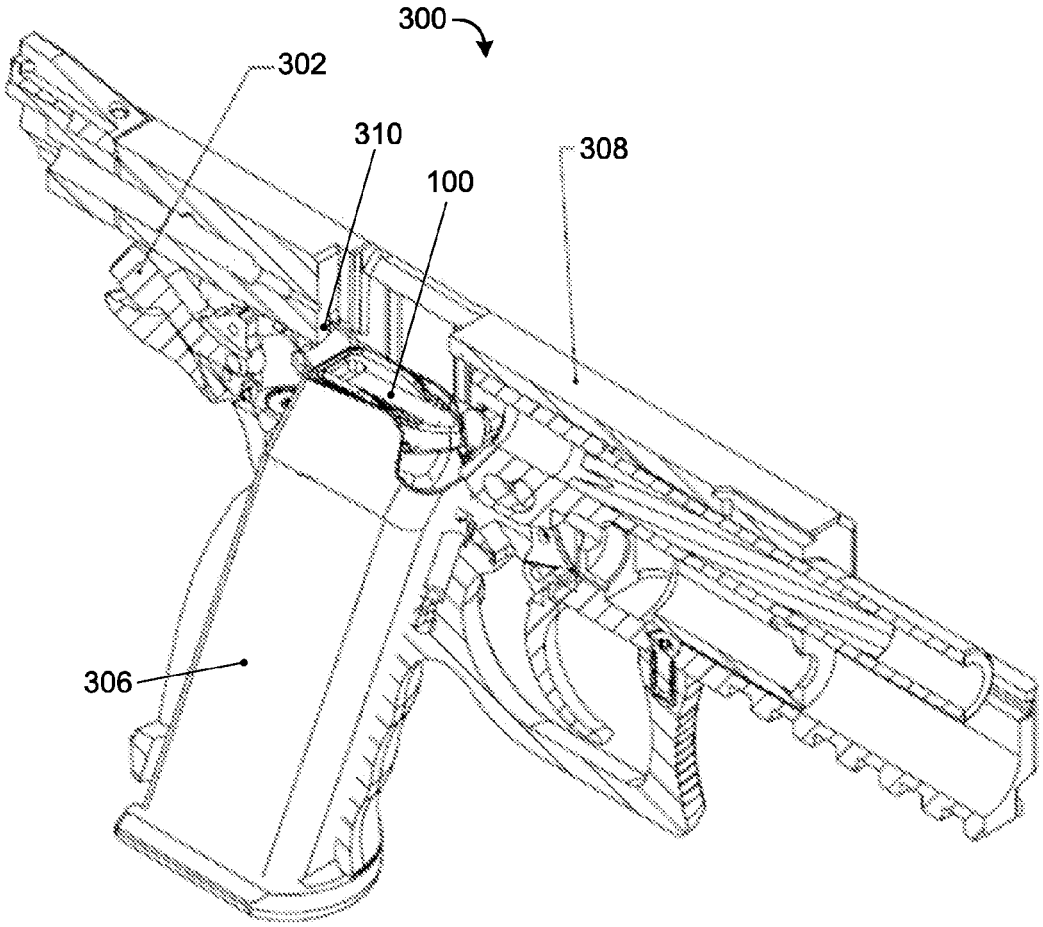
FIG. 9 is a cutaway view of a firearm wherein the firearm magazine houses a magazine block device preventing the slide lock from engaging.
Figure 12:
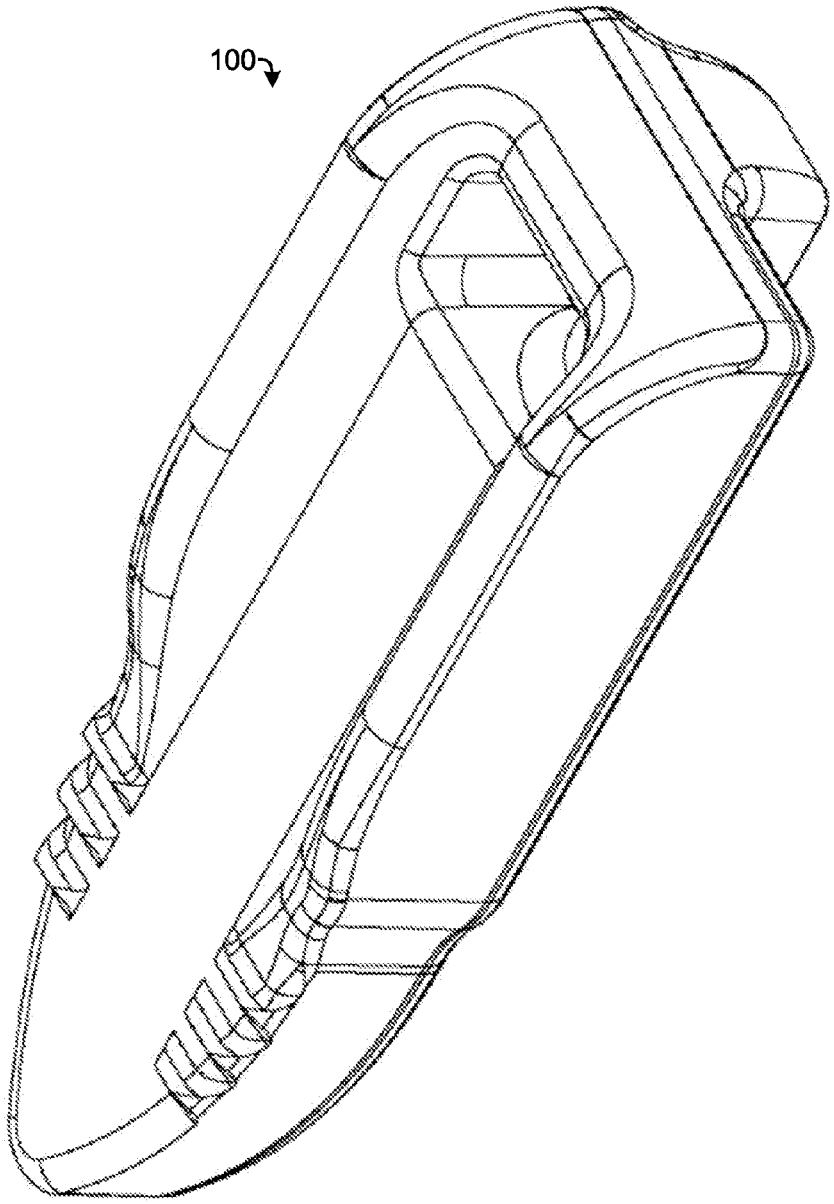
FIG. 12 is a rear top perspective view of a dry fire practice magazine block device, in accordance with an aspect of the present disclosure.
Figure 13:
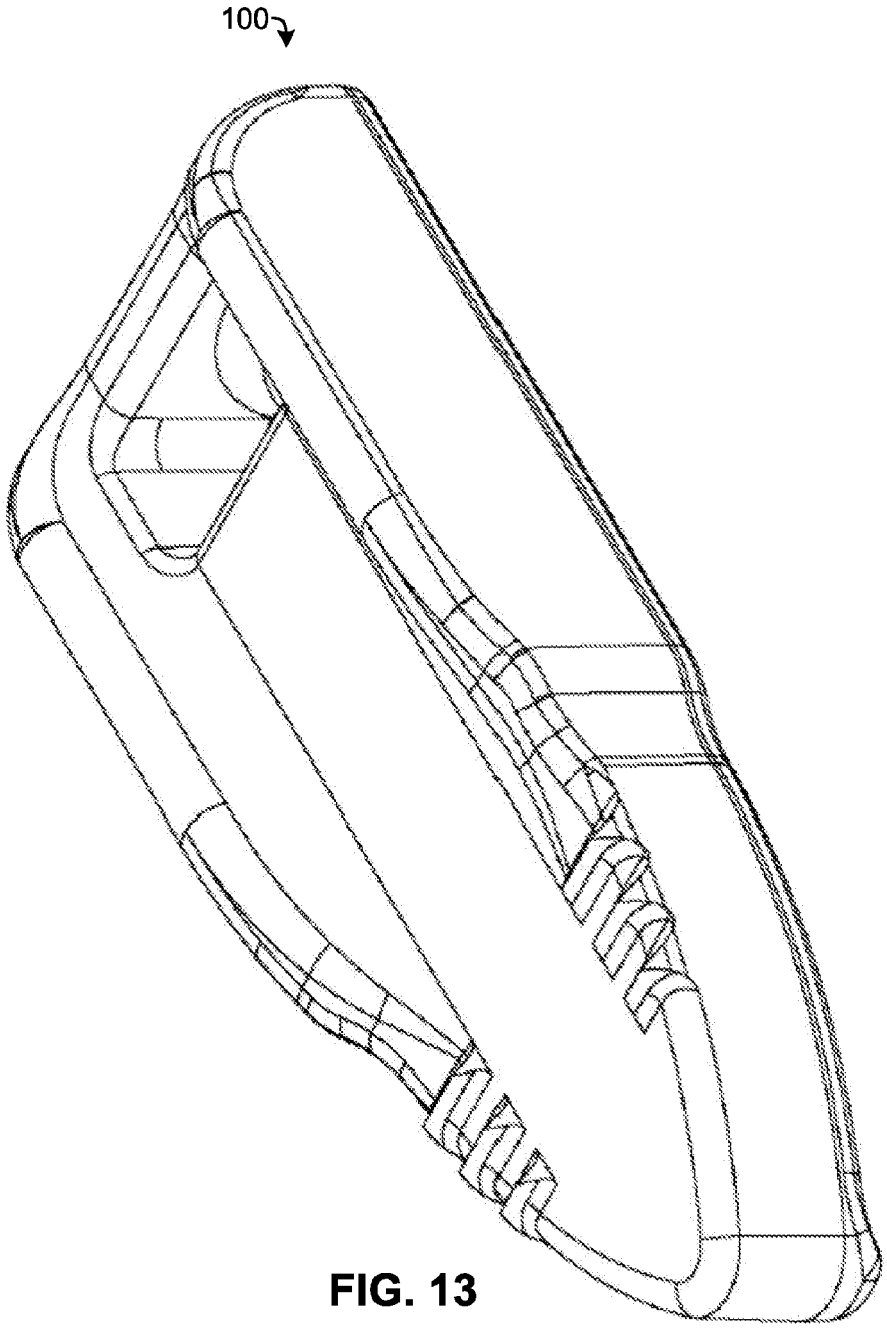
FIG. 13 is a front top perspective view thereof.
Figure 14:
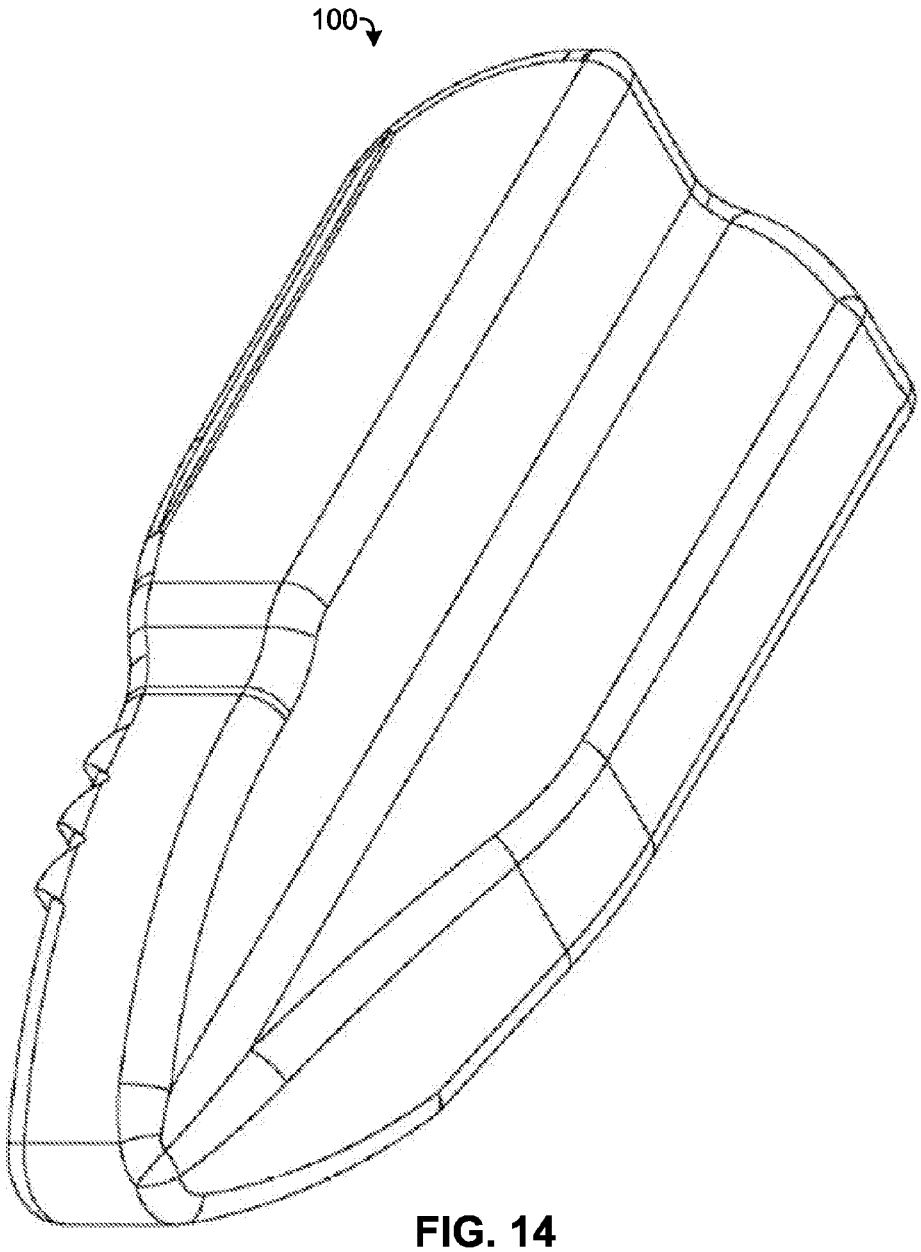
FIG. 14 is a front bottom perspective view thereof.
Figure 15:
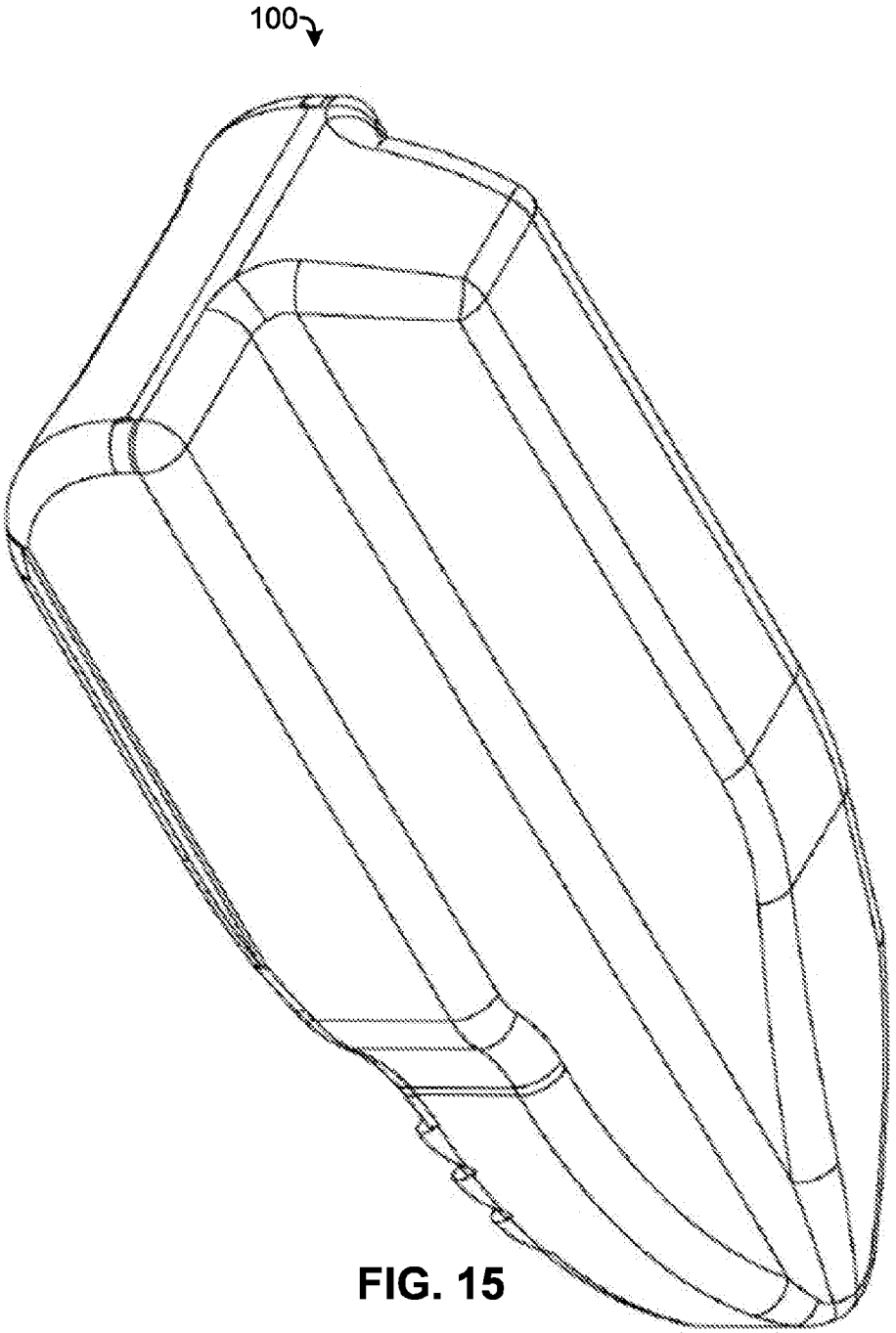
FIG. 15 is a rear bottom perspective view thereof.
Figure 16:
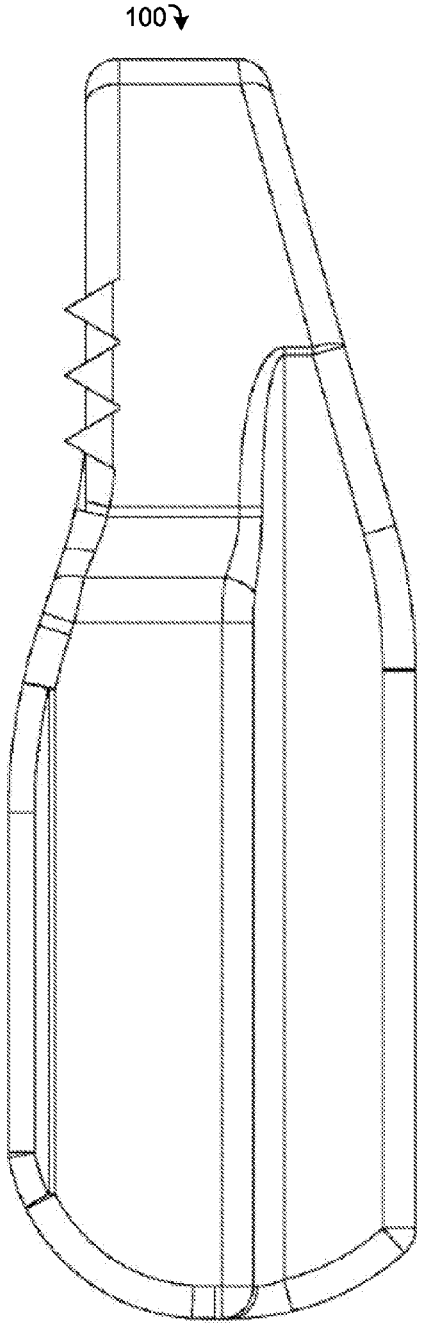
FIG. 16 is a left side elevational view thereof.
Figure 17:
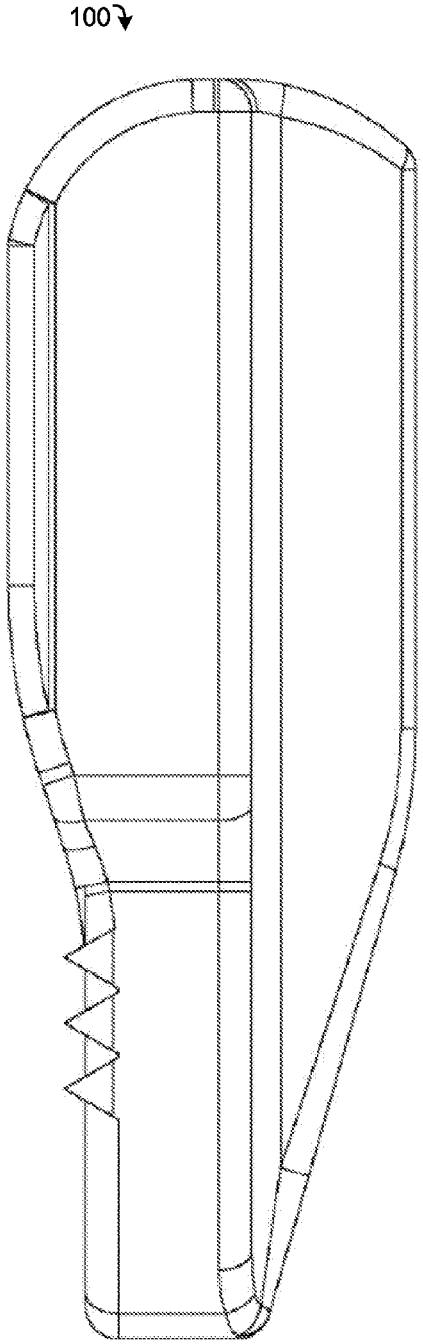
FIG. 17 is a right side elevational view thereof.
Figure 18:
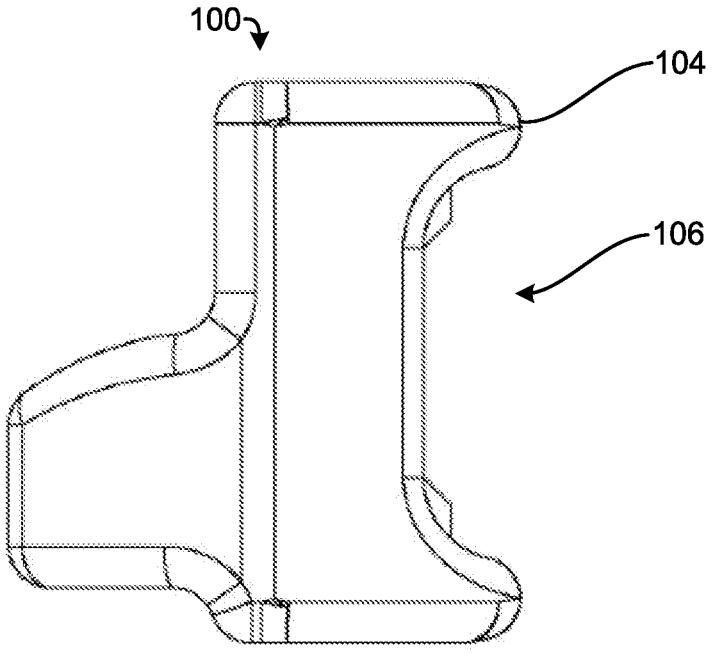
FIG. 18 is a rear end view thereof.
Figure 19:
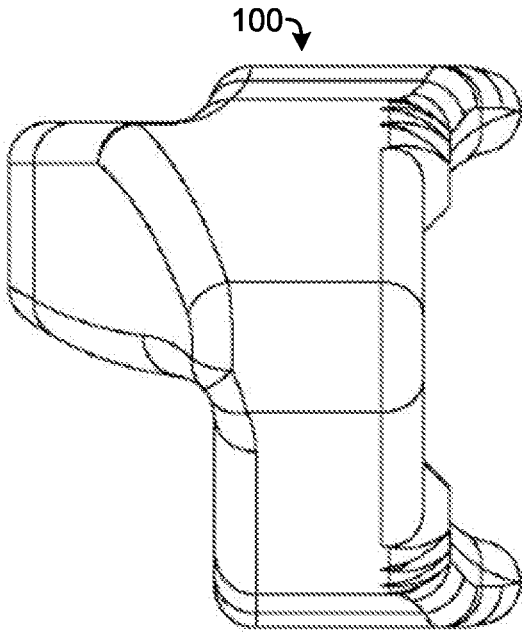
FIG. 19 is a front elevational view thereof.
Figure 20:
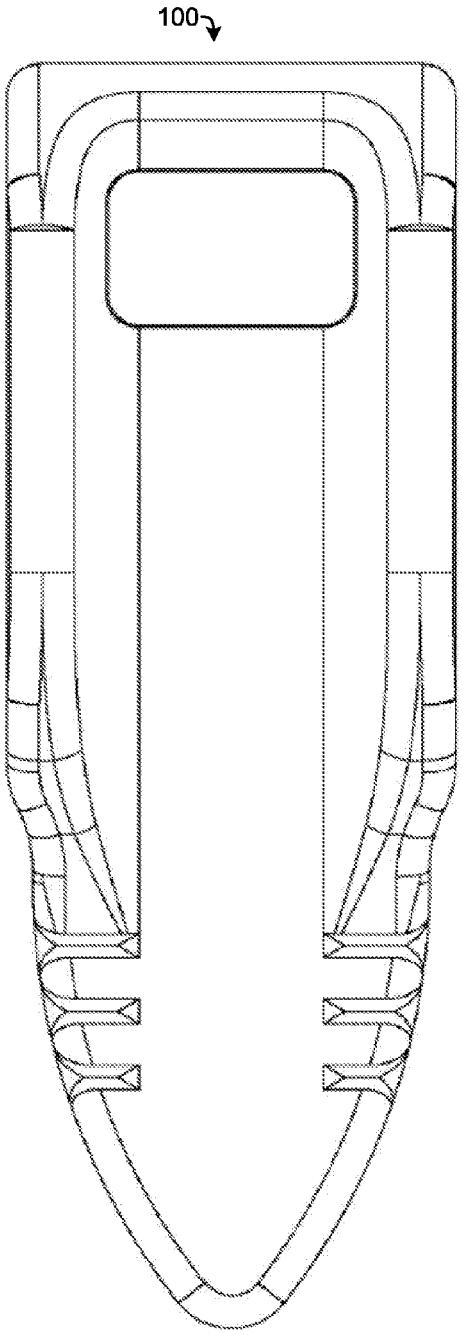
FIG. 20 is a front plan view thereof.
Figure 21:
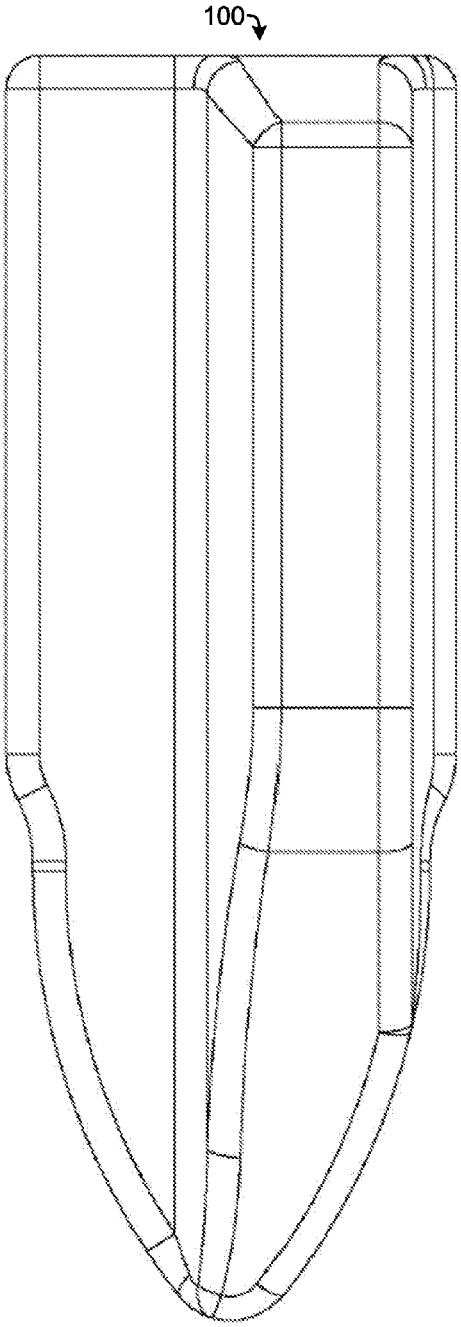
FIG. 21 is a bottom plan view thereof.
Figure 22:
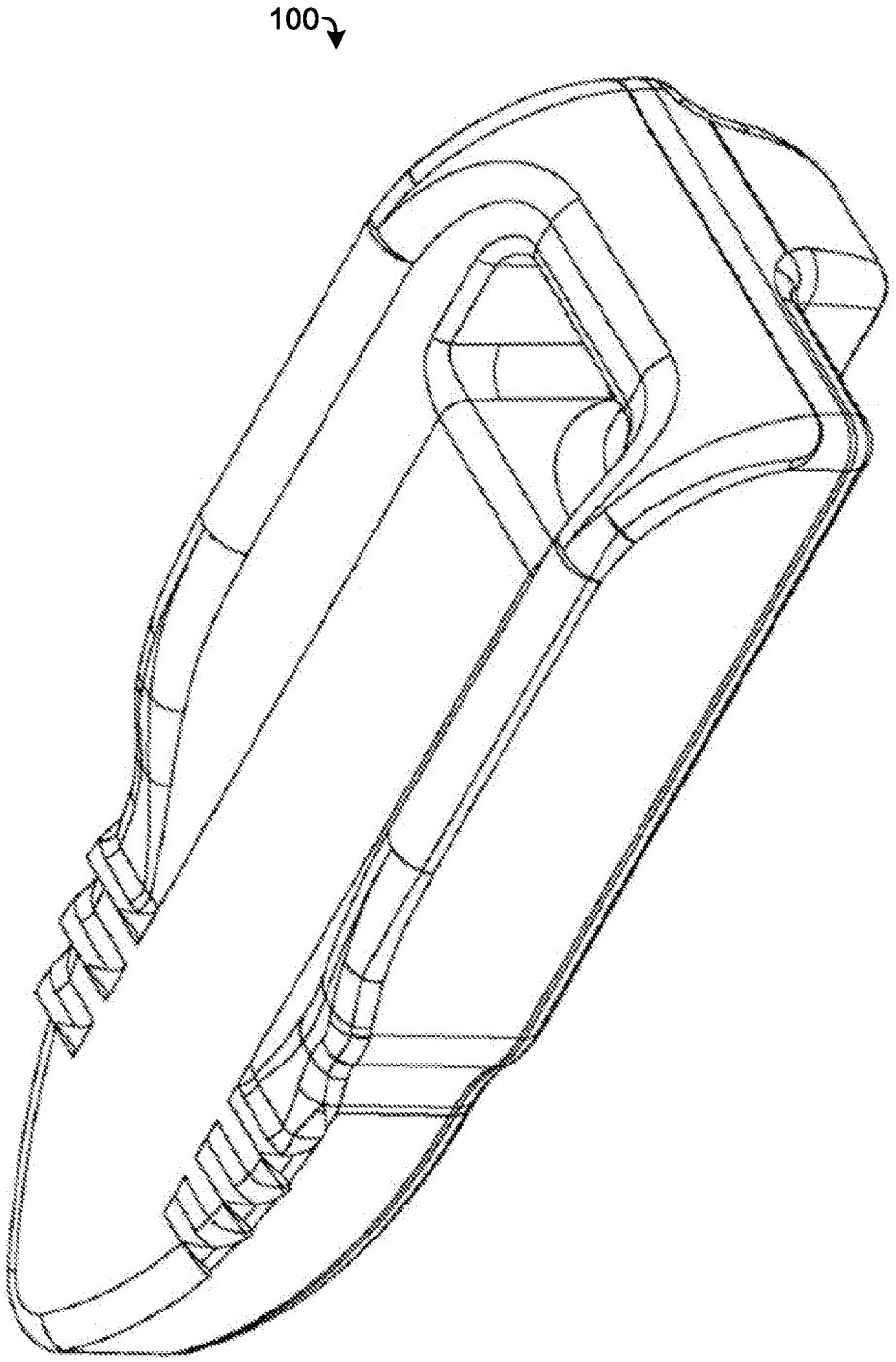
FIG. 22 is a rear top perspective view of another aspect of the dry fire practice magazine block device.
Figure 23:
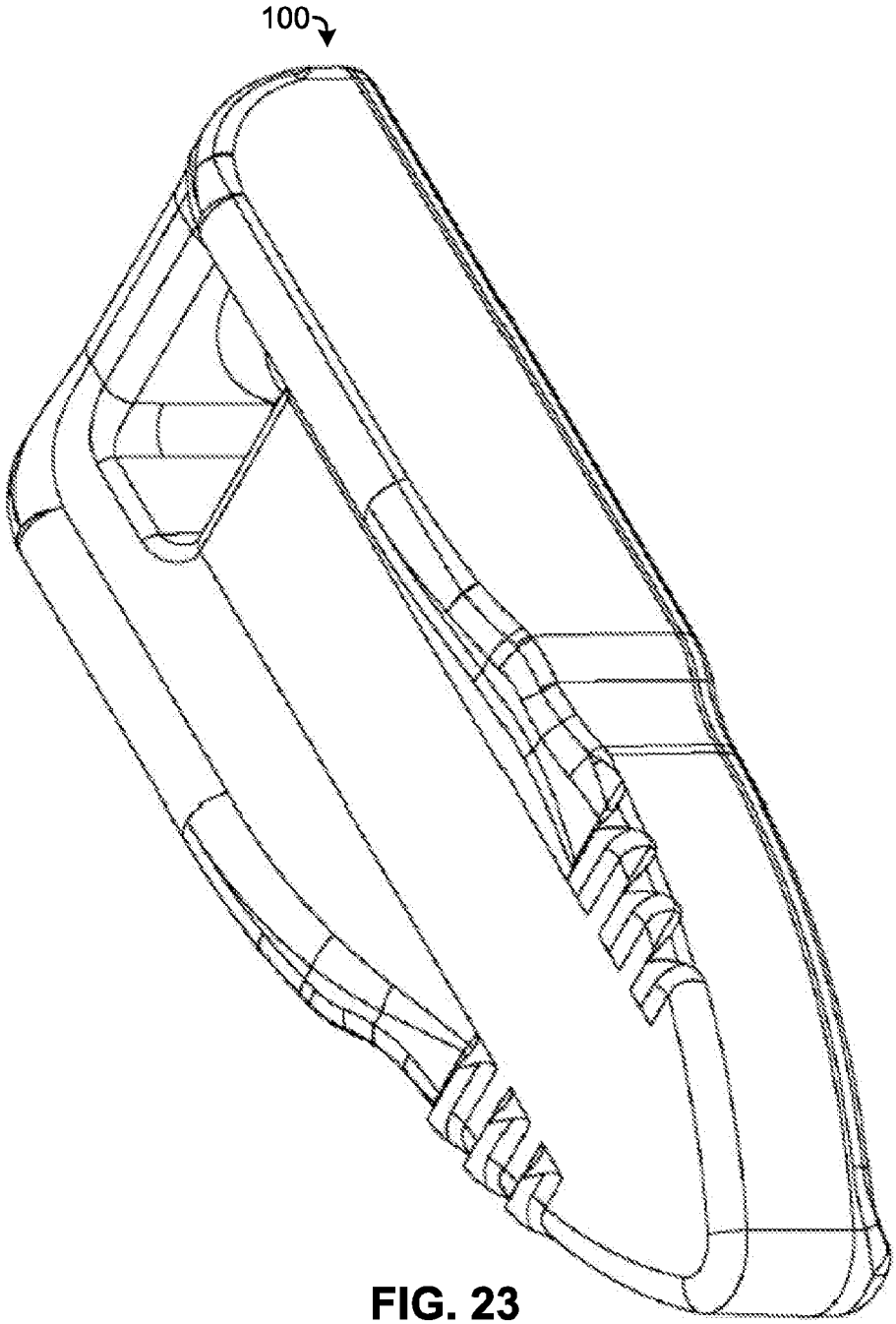
FIG. 23 is a front top perspective view thereof.
Figure 24:
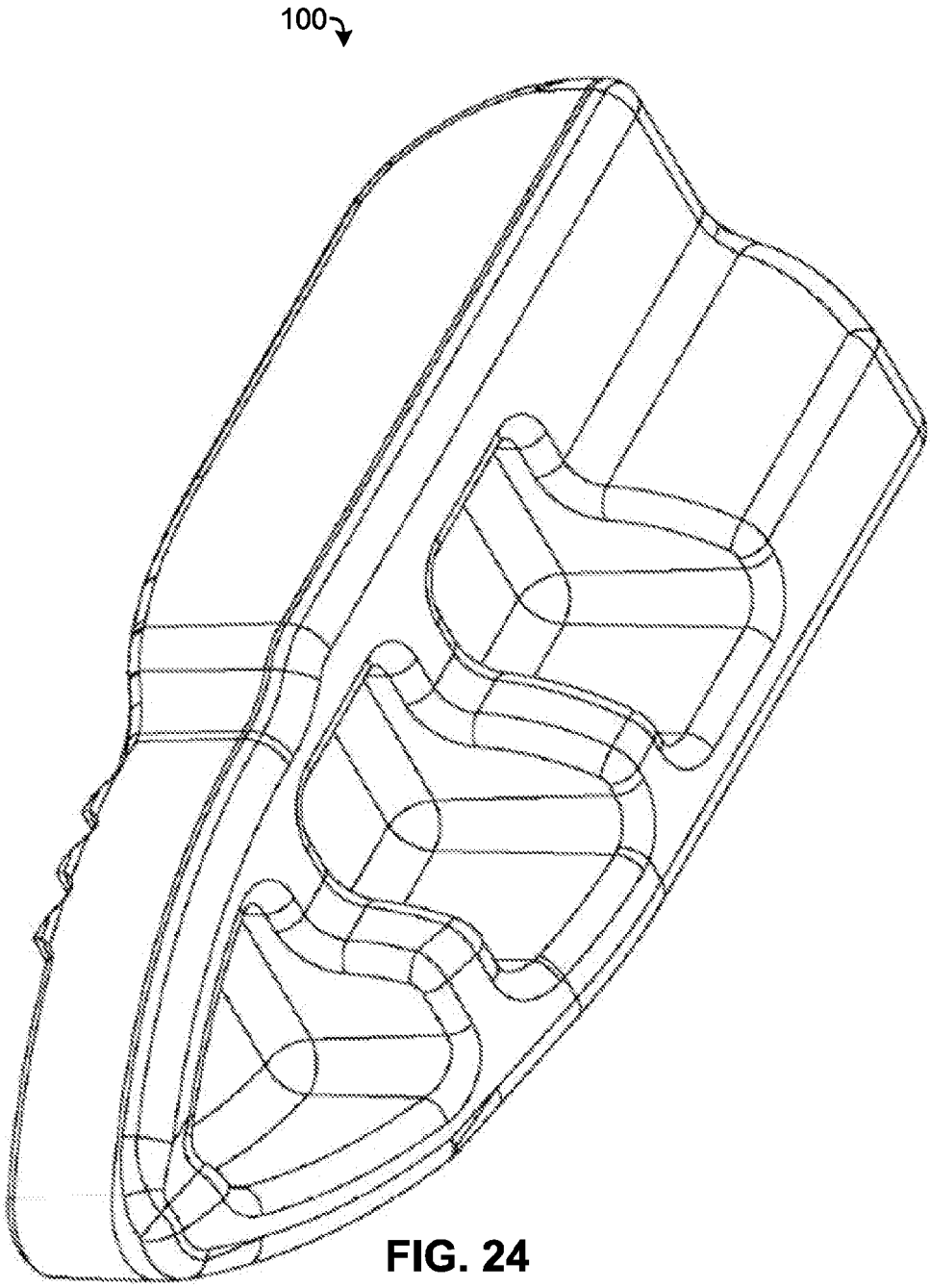
FIG. 24 is a front bottom perspective view thereof.
Figure 25:
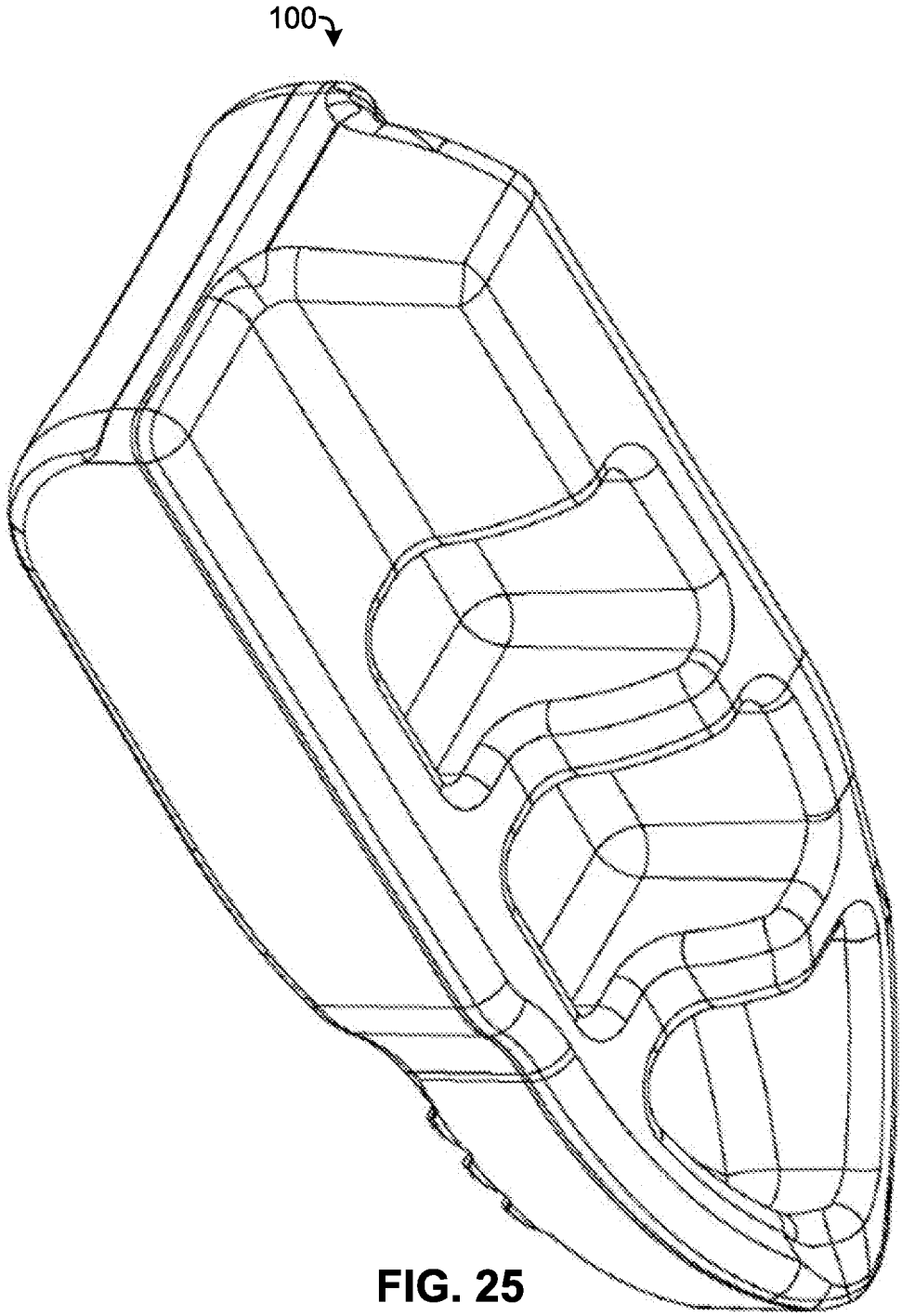
FIG. 25 is a rear bottom perspective view thereof.
Figure 26:
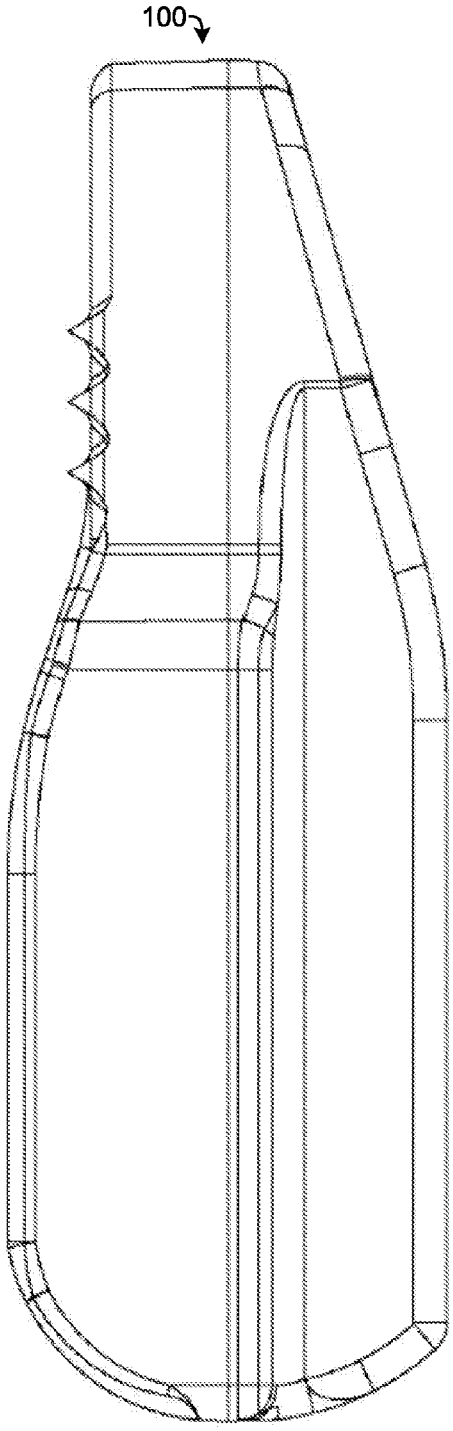
FIG. 26 is a left side elevational view thereof.
Figure 27:
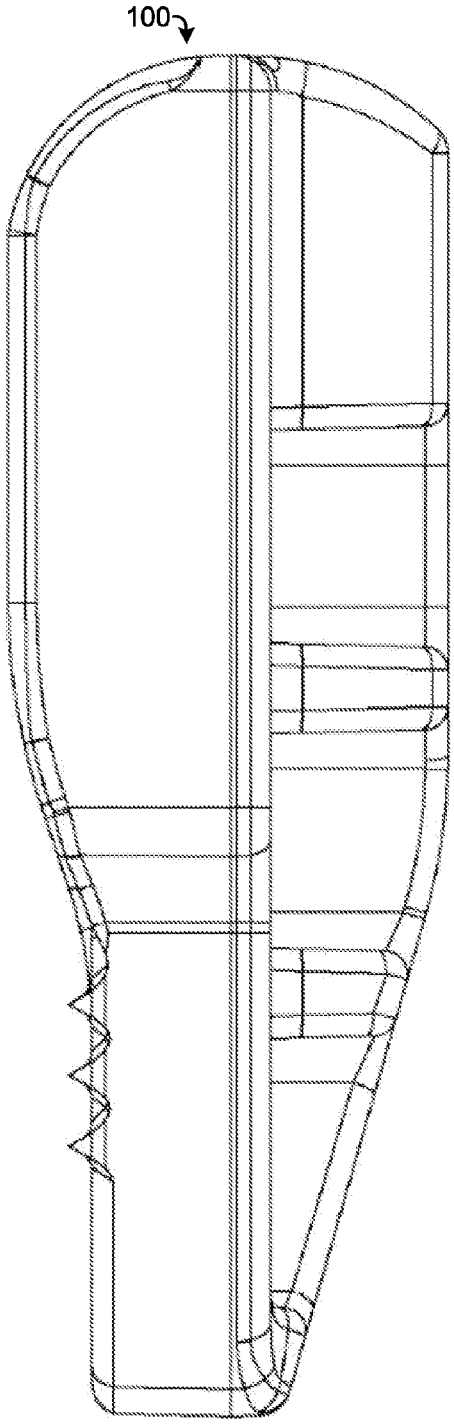
FIG. 27 is a right side elevational view thereof.
Figure 28:
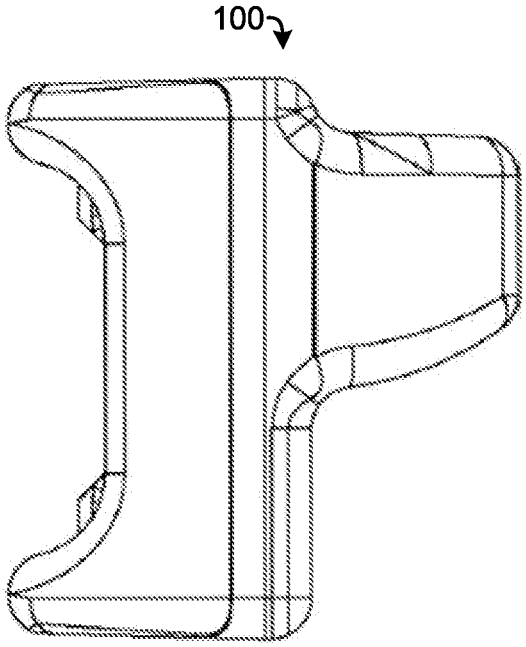
FIG. 28 is a rear end view thereof.
Figure 29:
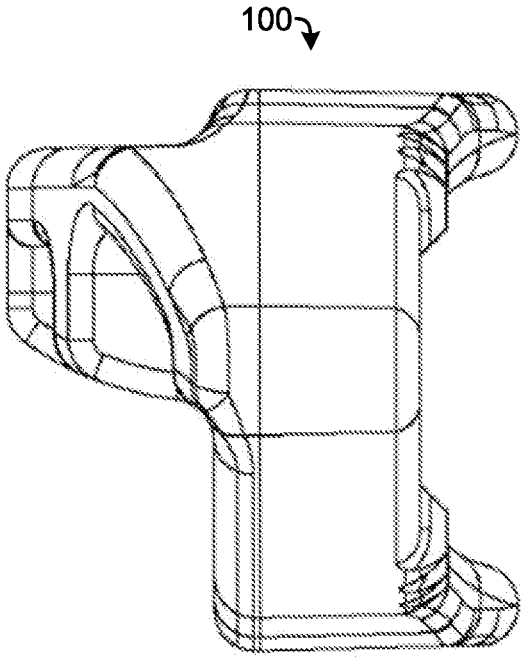
FIG. 29 is a front elevational view thereof.
Figure 30:
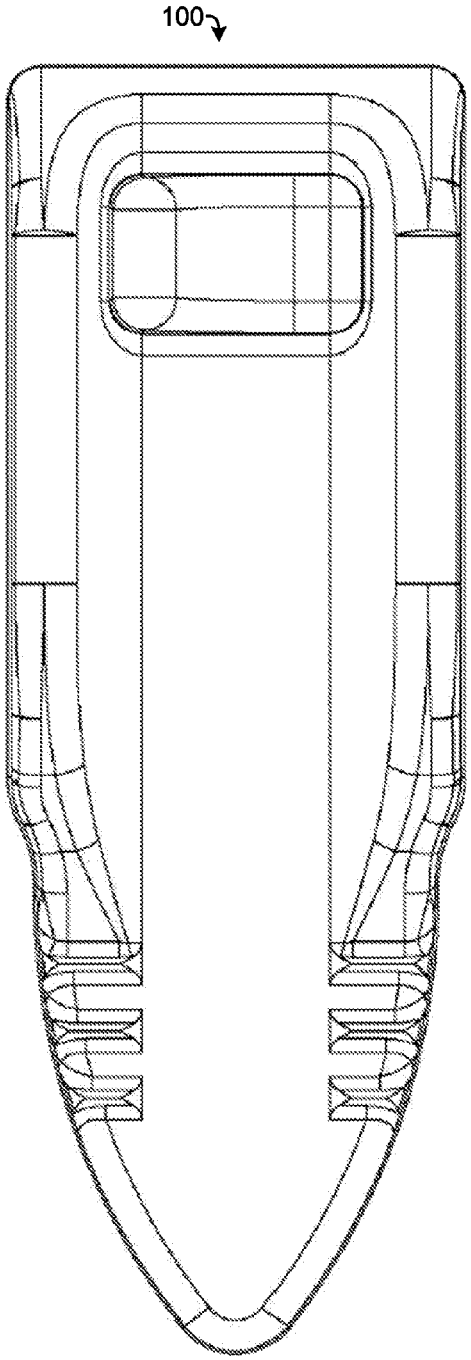
FIG. 30 is a front plan view thereof.
Figure 31:
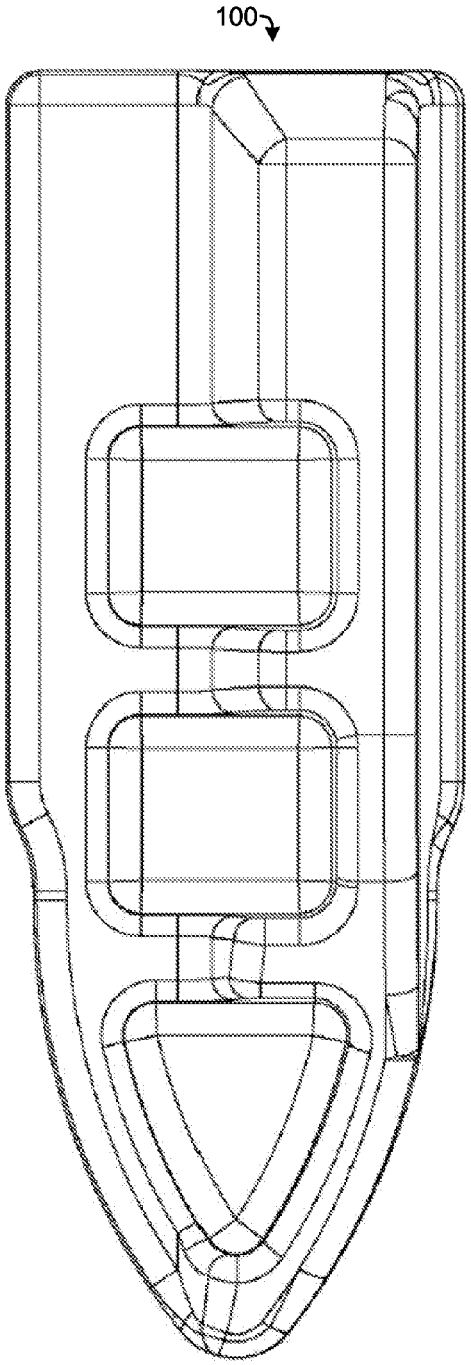
FIG. 31 is a bottom plan view thereof.

Referring briefly to FIGS. 9-11, a series of cutaway views are shown which depict the movement of slide 308 when firearm 300 is equipped with device 100. Slide 308 is able to move freely, enabling firearm 300 to be used in dry fire practice without having to constantly disengage slide lock 402 after every trigger pull and re-cock cycle.

Referring briefly to FIGS. 12-21, various views of a dry fire practice magazine block device 100, in accordance with an aspect of the present disclosure, are shown.

Referring briefly to FIGS. 22-31, various other views of another dry fire practice magazine block device 100, in accordance with an aspect of the present disclosure, are shown.

While various aspects of the present disclosure have been described above, it should be understood that they have been presented by way of example and not limitation. It will be apparent to persons skilled in the relevant art(s) that various changes in form and detail can be made without departing from the spirit and scope of the present disclosure. The present disclosure should not be limited by any of the above described aspects, but should be defined only in accordance with the following claims and their equivalents.

In addition, it should be understood that the figures, which highlight the structure, methodology, functionality and advantages of the present disclosure, are presented as examples only. The present disclosure is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any way.

What is claimed is:

1. A magazine block device for firearm dry fire practice, the firearm including a magazine having a follower, a slide having a breach face loading tab and a slide lock operable by the follower, the magazine block device comprising:

a body including a top body portion, a bottom body portion, a first side portion, and a second side portion, extending longitudinally and defining a magazine block device longitudinal axis;

a first upper ridge, extending vertically from the top body portion along a first outer side portion and parallel to the magazine block device longitudinal axis, including a top first upper ridge portion for contacting a first magazine feed lip;

a second upper ridge extending vertically from the top body portion along a second outer side portion and parallel to the magazine block device longitudinal axis, including a top second upper ridge portion for contacting a second magazine feed lip;

a channel formed between the first upper ridge and the second upper ridge, the channel, when inserted horizontally into the magazine, allowing the breach face loading tab to move laterally above the magazine block device without contact; and a lower ridge extending downward from the bottom body portion for, when inserted horizontally into the magazine, preventing upward movement of the follower into a slide lock engaging position.

2. The magazine block device of claim 1, wherein the lower ridge is offset from the magazine block device longitudinal axis.

3. The magazine block device of claim 2, wherein the lower ridge is offset from the magazine block device longitudinal axis for evenly receiving a spring force from a magazine follower within a staggered magazine.

4. The magazine block device of claim 1, wherein the magazine is adapted to carry an ammunition type, the body further including a curved front portion having a front portion curvature corresponding with an ammunition type cross section.

5. The magazine block device of claim 4, wherein the body having a body cross section, the body crass section corresponding with an ammunition type cross section.

6. The magazine block device of claim 1, further comprising:

a plurality of flanges positioned on the top body portion for assisting in removal of the magazine block device from the magazine.

7. The magazine block device of claim 6, wherein the plurality of lanes are two sets of three flanges positioned on opposite body sides.

8. The magazine block device of claim 6, wherein the plurality of flanges are positioned on the front portion.

9. The magazine block device of claim 1, further comprising:

a pocket inset within the top body portion, the pocket facilitating removal of he magazine block device from the magazine.

10. The magazine block device of claim 1, wherein the body includes a rear portion, the rear portion being rounded in a vertical plane.

11. The magazine block device of claim 1, wherein the first upper ridge and the second upper ridge each include a front upper ridge portion, each of the front upper ridge portions being rounded.

12. The magazine block device of claim 1, wherein the first upper ridge and the second upper ridge each include a rear upper ridge portion, each of the rear upper ridge portions being rounded.

13. The magazine block device of claim 1, wherein the lower ridge has a front lower ridge portion, the front lower ridge portions being rounded.

14. The magazine block device of claim 1, wherein the lower ridge has a rear lower ridge portion, the rear lower ridge portions being rounded.

15. A magazine block device for firearm dry fire practice, the firearm including a magazine, a round loading mechanism and a casing ejection mechanism operable by a casing ejection mechanism lock, the magazine block device comprising:

a body including a top body portion, a bottom body portion, a first side portion, and a second side portion, extending longitudinally and defining a magazine block device longitudinal axis, the top body portion contacting a magazine feed lip assembly;

a channel formed in the top body portion, the channel, when inserted horizontally into the magazine, allowing the round loading mechanism to move laterally above the magazine block device without contact; and a lower ridge extending downward from the bottom body portion for, when inserted horizontally into the magazine, preventing actuation of the casing ejection mechanism lock.

16. The magazine block device of claim 15, the magazine lip assembly includes a first magazine lip and a second magazine lip, the body further including:

a first upper ridge, extending vertically from the top body portion along an outer portion first side portion and parallel to the magazine block device longitudinal axis, and including a top first upper ridge portion for contacting the first magazine feed lip; and a second upper ridge, extending vertically from the top body portion along an outer second side portion and parallel to the magazine block device longitudinal axis, and including a top second upper ridge portion for contacting the second magazine feed lip;

wherein the channel is formed by the first upper ridge and the second upper ridge.

17. The magazine block device of claim 16, further including:

two sets of three flanges positioned on the top body portion for assisting in removal of the magazine block device from the magazine;

a pocket inset within the top body portion, the pocket facilitating removal of the magazine block device from the magazine;

a body rear portion rounded in a vertical plane;

a first front upper ridge portion and a second front upper ridge portion, each of the first front upper ridge portion and the second front upper ridge portion being rounded; and a front lower ridge portion, the front lower ridge portion being rounded.

18. The magazine block device of claim 15, wherein the magazine is adapted to carry an ammunition type, the body further including a curved front portion having a front portion curvature corresponding with an ammunition type cross section.

19. The magazine block device of claim 18, wherein the body having a body cross section, the body cross section corresponding with an ammunition type cross section.

20. A magazine block device for firearm dry fire practice, the firearm including a magazine having a follower, a slide having a breach face loading tab and a slide lock operable by the follower, the magazine block device comprising:

a body including a top body portion, a bottom body portion, a rounded rear portion, a first side portion, and a second side portion, extending longitudinally and defining a magazine block device longitudinal axis;

a first upper ridge, extending vertically from the top body portion along an outer portion first side portion and parallel to the magazine block device longitudinal axis, including a top first upper ridge portion for contacting a first magazine feed lip;

a second upper ridge extending vertically from the top body portion along an outer second side portion and parallel to the magazine block device longitudinal axis, including a top second upper ridge portion for contacting a second magazine feed lip;

a channel formed between the first upper ridge and the second upper ridge, the channel, when inserted horizontally into the magazine, allowing the breach face loading tab to move laterally above the magazine block device without contact;

a lower ridge extending downward from the bottom body portion for, when inserted horizontally into the magazine, preventing upward movement of the follower into a slide lock engaging position, the lower ridge offset from the magazine block device longitudinal axis for evenly receiving a spring force from a magazine follower within a staggered magazine;

two sets of three flanges positioned on the top body portion for assisting in removal of the magazine block device from the magazine;

a pocket inset within the top body portion, the pocket facilitating removal of the magazine block device from the magazine;

a first front upper ridge portion and a second front upper ridge portion, each of the first front upper ridge portion and the second front upper ridge portion being rounded; and a front lower ridge portion, the front lower ridge portion being rounded;

wherein the magazine is adapted to carry an ammunition type, the body further has a curved front portion, the body having a body cross section, the body cross section corresponding with an ammunition type cross section.

* * * * *